US012486855B2

(12) United States Patent
Kim et al.

(10) Patent No.: US 12,486,855 B2
(45) Date of Patent: Dec. 2, 2025

(54) AIR BLOWER

(71) Applicant: COWAY CO., LTD., Gongju-si (KR)

(72) Inventors: Bong Suk Kim, Gongju-si (KR); Sang Gu Sim, Gongju-si (KR); Myung Jin Park, Gongju-si (KR); Sung Jin Kim, Gongju-si (KR); Sung Jae Lee, Gongju-si (KR)

(73) Assignee: COWAY CO., LTD., Gongju-si (KR)

( * ) Notice: Subject to any disclaimer, the term of this patent is extended or adjusted under 35 U.S.C. 154(b) by 0 days.

(21) Appl. No.: 18/709,907

(22) PCT Filed: Jul. 6, 2022

(86) PCT No.: PCT/KR2022/009795
§ 371 (c)(1),
(2) Date: May 14, 2024

(87) PCT Pub. No.: WO2023/096050
PCT Pub. Date: Jun. 1, 2023

(65) Prior Publication Data

US 2025/0012291 A1 Jan. 9, 2025

(30) Foreign Application Priority Data

Nov. 24, 2021 (KR) ..... 10-2021-0163800

(51) Int. Cl.
*F04D 29/42* (2006.01)
*F04D 17/08* (2006.01)
*F04D 29/28* (2006.01)

(52) U.S. Cl.
CPC ..... *F04D 29/4226* (2013.01); *F04D 17/08* (2013.01); *F04D 29/283* (2013.01)

(58) Field of Classification Search
CPC .... F04D 29/42; F04D 29/424; F04D 29/4226; F04D 29/4246; F04D 25/06; F04D 25/08; F04D 25/10; F04D 25/166; F04D 17/162
See application file for complete search history.

(56) References Cited

U.S. PATENT DOCUMENTS 5,893,705 A * 4/1999 Khan ..... F04D 17/105 417/423.12
6,209,622 B1 * 4/2001 Lagace ..... F24F 3/1423 165/8

(Continued)

FOREIGN PATENT DOCUMENTS

KR 10-2017-0050260 A 5/2017
KR 10-2018-0010056 A 1/2018

(Continued)

OTHER PUBLICATIONS

International Search Report mailed on Oct. 19, 2022 in PCT/KR2022/009795 filed on Jul. 6, 2022 (2 pages).

*Primary Examiner* — Courtney D Heinle
*Assistant Examiner* — Cameron A Corday
(74) *Attorney, Agent, or Firm* — Oblon, McClelland, Maier & Neustadt, L.L.P.

(57) ABSTRACT

An air blower is disclosed. An air blower according to an aspect of the present invention includes: a fan member rotatably provided to provide transfer force to fluid; a flow passage-forming member accommodating the fan member, having a space that communicates with the outside, and including an outer periphery that encompasses the fan member; a scroll unit rotatably accommodated in the space of the flow passage-forming member; and a housing, which communicates with the space of the flow passage-forming member and the outside, covers the space of the flow passage-forming member and the scroll part, and is coupled to the flow passage-forming member, wherein the scroll unit (Continued)

includes: a scroll motor fixedly coupled to the housing; a scroll body coupled to the scroll motor so as to rotate by means of the operation of the scroll motor; and a scroll opening penetrating the outer periphery of the scroll body so as to allow the space of the flow passage-forming member to communicate with the outside.

18 Claims, 12 Drawing Sheets

(56) References Cited

U.S. PATENT DOCUMENTS 10,337,523 B2 * 7/2019 Chou ..... F04D 25/0606
10,598,190 B2 * 3/2020 Kim ..... F04D 29/703
11,067,089 B2 * 7/2021 Kim ..... F24F 1/0029
2003/0026600 A1 * 2/2003 Delonghi ..... F04D 25/10
392/367
2016/0108928 A1 * 4/2016 Son ..... F24F 1/0033
415/205
2017/0284413 A1 10/2017 Kim et al.
2018/0023579 A1 * 1/2018 Park ..... F04D 29/703
310/40.5
2018/0023582 A1 * 1/2018 Park ..... F04D 17/162
417/44.1
2020/0309406 A1 * 10/2020 Ryu ..... F24F 13/1426
2021/0293250 A1 * 9/2021 Ku ..... F04D 27/004

FOREIGN PATENT DOCUMENTS

KR 10-1821544 B1 1/2018
KR 10-2018-0138247 A 12/2018
KR 10-2019-0114472 A 10/2019
WO WO 2017/146353 A1 8/2017

* cited by examiner

AIR BLOWER

TECHNICAL FIELD

The present invention relates to an air blower, and more particularly, to an air blower having a structure capable of forming various directions of a discharged flow passage.

BACKGROUND

An air blower refers to any device that can suck in external air and discharge the sucked air back to the outside. Air purifiers to remove dust, etc. staying indoors, including filter units, humidifiers or dehumidifiers that supply or remove moisture to/from the inhaled air, as well as general electric fans that circulate indoor air, are all types of air blowers.

In addition, air blowers can also be used to refresh air components in specific spaces of the room. For example, if a user stays in a specific space for a long time, the carbon dioxide concentration in that space is likely to be particularly high. Accordingly, the air blower may communicate with the corresponding space and another space to circulate air having an appropriate composition for the user to live.

In the case of the recent outbreak of COVID-19, cases of increased contagiousness in confined indoor spaces have been reported. Accordingly, interest in ventilation through the circulation of air staying indoors as well as ventilation using outdoor air is increasing, and air blowers are attracting attention.

The air blower is provided with a fan for sucking outside air and discharging the sucked outside air in a desired direction again. The fan may provide a transfer force for sucking air and discharging the air through an opening communicating the inside and the outside of the air blower.

In the traditional type of air blower, a member for suctioning air and a member for discharging air are formed to be spaced apart in the up-down direction. This is because the above structure is advantageous in forming a flow passage therein for air to be sucked in and then discharged.

In the case of the air blower of the above structure, a member that discharges air is generally provided to be rotatable in order to form various flow passages for the discharged air. The member is configured to be exposed to the outside of the air blower and rotated. The user can intuitively perceive the direction of air discharge through the member.

However, in an environment equipped with an air blower, not only adults but also infants and animals can reside together. In the case of infants or animals lacking cognitive ability, they are curious about rotating members and have a strong tendency to touch them with their bodies. In this case, there is a possibility that a safety accident may occur due to the rotating member.

Accordingly, air blowers configured to have a member through which air is discharged mounted on the inside or fixed thereto are commercially available. However, this type of air blower has a limitation in that it is difficult to form a discharge flow passage of air in various directions.

Accordingly, technologies for forming various flow passages through which air is discharged have been introduced.

Korean Patent Laid-Open Publication No. 10-2018-0138247 discloses an air purifier with two-way fans in different discharge directions. Specifically, it discloses an air purifier in which a plurality of fans for discharging air are arranged in the up-down direction, and the direction of air discharged from each fan can be adjusted.

However, an air purifier with this structure has a limitation in that it is difficult to diversify the direction of air discharged from each fan. That is, the air purifier disclosed in the prior art document is configured such that the upper fan always discharges air only toward the upper side, and only the lower fan discharges air toward either the left, right, or upper side. Accordingly, the prior art document only discloses a configuration for discharging at least some of the air toward the upper side at all times.

International Patent Publication No. 2017-146353 discloses an air purifier. Specifically, it discloses an air purifier capable of forming various air discharge passages, including a sub-fan and a flow control device for controlling the flow direction of air passing through the air purification module.

However, the air purifier disclosed in the prior art document also forms an air flow passage from the bottom to the top, and a rotating member is coupled to the top. Accordingly, the above prior art document also does not suggest measures related to preventing the above-mentioned safety accidents.

Furthermore, in the above-mentioned prior art documents, the member discharging air is arranged to face upward. Therefore, as the use of the air blower or air purifier continues, there is a possibility that dust, etc. may flow into the air blower or air purifier due to gravity.

Korean Patent Laid-Open Publication No. 10-2018-0138247 (2018. Dec. 31.)

International Patent Publication No. 2017-146353 (2017. Aug. 31.)

SUMMARY OF THE INVENTION

Technical Problem

The present invention is to solve the above problems, and is directed to providing an air blower with a structure capable of forming various discharge flow passages.

The present invention is directed to providing an air blower with a structure in which the member that provides transfer force to the fluid is not exposed to the outside.

The present invention is directed to providing an air blower with a structure capable of forming a plurality of fluid discharge flow passages.

The present invention is directed to providing an air blower with a structure in which a plurality of fluid discharge flow passages can be formed independently of each other.

The present invention is directed to providing an air blower with a structure in which the direction of a plurality of fluid discharge flow passages can be changed in various ways.

The problems of the present invention are not limited to those mentioned above, and other problems not mentioned will be clearly understood by those of ordinary skill in the art from the following description.

Technical Solution

According to an aspect of the present invention, provided is an air blower, including: a fan member rotatably provided to provide transfer force to a fluid; a flow passage-forming member that accommodates the fan member, has a space formed to communicate with the outside, and includes an outer circumference surrounding the fan member; a scroll unit rotatably accommodated in the space of the flow passage-forming member; and a housing that communicates with the space of the flow passage-forming member and the outside, covers the space of the flow passage-forming member and the scroll unit, and is coupled to the flow passage-forming member, wherein the scroll unit includes: a scroll motor fixedly coupled to the housing; a scroll body coupled to the scroll motor and rotated by the operation of the scroll motor; and a scroll opening formed through an outer circumference of the scroll body and communicating the space of the flow passage-forming member with the outside, and wherein when the fan member is operated, external fluid flows into the space in the axial direction of the flow passage-forming member and is discharged in the outer circumferential direction of the flow passage-forming member through the scroll opening, and as the scroll unit is rotated, the position of the scroll opening changes, and the direction in which the fluid is discharged to the outside is adjusted.

In this case, an air blower is provided in which a plurality of the scroll units are provided, and the plurality of scroll units are arranged side by side along an axial direction of the flow passage-forming member in the space of the flow passage-forming member.

In addition, an air blower is provided in which the scroll unit includes: a first scroll positioned to be biased on one side of the space of the flow passage-forming member; and a second scroll positioned to be biased on the other side of the space of the flow passage-forming member, and the scroll motor is provided on each of the first scroll and the second scroll and configured to rotate independently of each other.

In this case, an air blower is provided in which the fan member is configured to suck the fluid through one side and the other side in the axial direction, a portion of the fluid introduced into the space of the flow passage-forming member passes through the scroll opening of the first scroll and is discharged to the outside, and the remaining portion of the fluid introduced into the space of the flow passage-forming member passes through the scroll opening of the second scroll and is discharged to the outside.

In addition, an air blower is provided in which the flow passage-forming member includes: a partition wall extending in the cross-sectional direction and partitioning the space into a plurality of spaces, and the scroll unit includes: a first scroll and a second scroll disposed to face each other with the partition wall therebetween.

In this case, an air blower is provided in which the scroll motor provided in the first scroll and the scroll motor provided in the second scroll are controlled the same in one or more of operation status, rotation speed, and rotation direction.

In addition, an air blower is provided in which the first scroll is rotated in one direction of the clockwise direction and the counterclockwise direction, and the second scroll is rotated in the other direction of the clockwise direction and the counterclockwise direction.

In this case, an air blower is provided in which the first scroll and the second scroll are rotated in the same direction of the clockwise direction and the counterclockwise direction.

In addition, an air blower is provided in which the scroll unit includes: a scroll gear located inside the scroll body and coupled to the scroll body to rotate together; and a driving gear coupled to the scroll motor and gear-fitted with the scroll gear.

In this case, an air blower is provided in which on the outer circumference of the scroll gear, a plurality of toothing parts that are gear-fitted with the driving gear are formed.

In addition, an air blower is provided in which on the inner circumference of the scroll gear, a plurality of toothing parts that are gear-fitted with the driving gear are formed.

In this case, an air blower is provided in which inside the housing, a filter member configured to filter fluid introduced into the space of the flow passage-forming member by the fan member is accommodated.

In addition, an air blower is provided in which the filter member includes: a first filter positioned to be biased on one side of the fan member; and a second filter positioned to be biased on the other side of the fan member, and disposed to face the first filter with the fan member interposed therebetween.

In this case, an air blower is provided in which the scroll unit includes: a plate member formed in a plate shape having a shape corresponding to the space of the flow passage-forming member; and a scroll outer circumferential part extending along the outer circumference of the plate member, protruding from the plate member, and surrounded by the outer circumference of the flow passage-forming member, and the scroll opening is formed through the scroll outer circumferential part.

In addition, an air blower is provided in which the flow passage-forming member includes: a scroll accommodation part that is a space for accommodating the scroll unit; an outer circumferential part surrounding the scroll accommodation part from the radially outer side; and a plurality of ribs formed on the outer circumferential part and extending at a predetermined angle with respect to the axial direction of the flow passage-forming member, and the plurality of ribs are arranged to be spaced apart from each other, and the space of the flow passage-forming member communicates with the outside through a space between the ribs adjacent to each other.

In this case, an air blower is provided in which a plurality of the scroll units are provided, and the plurality of scroll units are arranged side by side along the axial direction of the flow passage-forming member in the space of the flow passage-forming member, the flow passage-forming member includes: a first portion arranged to surround the outer circumference of any one scroll unit of the plurality of scroll units; and a second portion arranged to surround the outer circumference of another scroll unit of the plurality of scroll units, and the rib formed in the first portion and the rib formed in the second portion extend in different directions.

In addition, an air blower is provided in which among the plurality of ribs, the ribs adjacent to each other extend parallel to each other.

In this case, an air blower is provided in which a neck unit supporting the flow passage-forming member is further included, the neck unit is provided on an external body part to be rotatable around the axial direction of the neck unit, the flow passage-forming member is rotated with respect to the axial direction of the neck unit, and the scroll unit is rotated with respect to the axial direction of the flow passage-forming member.

Advantageous Effects

According to the above configuration, the air blower according to an exemplary embodiment of the present invention can form air discharge flow passages in various ways.

First, a scroll unit is provided in the air blower. The scroll unit is rotatably provided inside the air blower. When a fan member that provides transfer force to the fluid is operated, the external fluid flows into the inside of the air blower along the axial direction of the fan member. The introduced air flows out in the radial outward direction of the fan member.

In this case, a scroll opening is formed through the scroll unit to communicate a space where the fan member is accommodated with the outside. Other parts except for the scroll opening are surrounded by a scroll outer circumferential part, blocking arbitrary outflow of fluid. That is, the introduced fluid may be discharged to the outside only through the scroll opening.

Therefore, as the scroll unit rotates, the relative position of the scroll opening may be changed, and as a result, the direction in which the fluid is discharged to the outside may also be changed. Accordingly, the discharge flow passage of the introduced fluid may be formed in various ways.

In addition, according to the above configuration, the air blower according to an exemplary embodiment of the present invention does not expose a member for providing the transfer force to the fluid to the outside.

First, a flow passage-forming member is provided in the air blower. The flow passage-forming member forms a part of the outside of the air blower, but has a component for mounting other components therein. A fan member that provides transfer force to the fluid is rotatably accommodated in the space of the flow passage-forming member.

The flow passage-forming member is coupled to a housing. A space communicating with the outside and the space of the flow passage-forming member is formed inside the housing. The housing covers the fan member accommodated in the flow passage-forming member and may be coupled to the flow passage-forming member.

Therefore, the fan member is surrounded by the housing and the flow passage-forming member and is not arbitrarily exposed to the outside. Accordingly, even if the fan member or the air blower is operated, safety accidents caused by infants or animals can be prevented.

In addition, according to the above configuration, the air blower according to an exemplary embodiment of the present invention can form a plurality of fluid discharge flow passages.

That is, a plurality of scroll units are provided. The plurality of scroll units are rotatably accommodated in a space formed inside the housing and the flow passage-forming member. The plurality of scroll units are configured to be spaced apart from each other to form a flow passage through which the introduced fluid flows out to the outside, respectively.

Therefore, the introduced fluid can be discharged to the outside through each of the plurality of scroll units. Accordingly, a plurality of outflow passages of the fluid may be formed, and may extend in different directions.

In addition, according to the above configuration, the air blower according to an exemplary embodiment of the present invention can form a plurality of fluid discharge flow passages independently of each other.

First, the scroll unit includes a scroll body forming a body and a scroll motor for rotating the scroll body. In an embodiment in which the scroll unit includes a plurality of scroll bodies, a plurality of scroll bodies are respectively coupled to a plurality of scroll motors. The rotation, direction, and speed of the plurality of scroll motors respectively provided in the plurality of scroll units can be independently controlled.

A scroll opening is formed in each scroll body. As the plurality of scroll motors are controlled independently of each other, the plurality of scroll openings formed in each of the plurality of scroll bodies can also be rotated independently of each other to form air outflow passages at different positions.

Accordingly, while a plurality of fluid discharge flow passages are formed, the directions of the plurality of fluid discharge flow passages can be formed independently of each other. Accordingly, the fluid discharged from the air blower may flow in various directions in the space.

In addition, according to the above configuration, the air blower according to an exemplary embodiment of the present invention can change the direction of the plurality of fluid discharge flow passages in various ways.

As described above, the scroll unit includes a plurality of scrolls whose rotation is controlled independently of each other. As the plurality of scrolls rotate independently of each other, the fluid discharge flow passage can be discharged in various directions with respect to the radial direction of the fan member.

In an embodiment, the scroll unit is provided as a component of the head unit. The head unit is rotatably coupled to the neck unit supporting it. The neck unit may be provided to be rotatable in the height direction, that is, around the Z axis.

Therefore, the air blower can be rotated around the central axis of the scroll unit (i.e., one of the X-axis and the Y-axis) and the Z-axis, respectively. Accordingly, the fluid discharged from the air blower can proceed in various directions in the three-dimensional space, and can be evenly transmitted to the entire space.

Advantageous effects of the present invention are not limited to the above-described effects, and should be understood to include all effects that can be inferred from the configuration of the invention described in the detailed description or claims of the present invention.

DETAILED DESCRIPTION OF THE EMBODIMENTS

Figure 1:
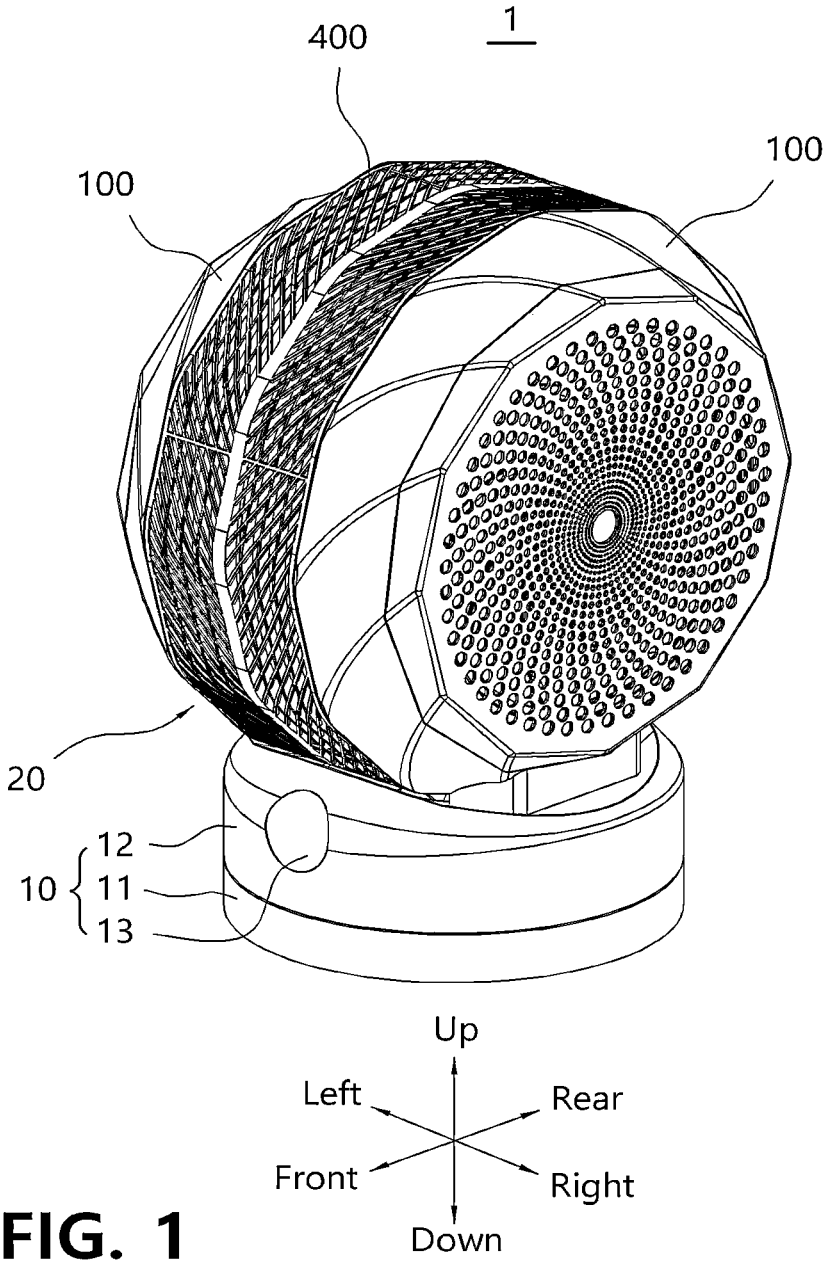
FIG. 1 is a perspective view illustrating an air blower according to an exemplary embodiment of the present invention.

Hereinafter, exemplary embodiments of the present invention will be described in detail so that those of ordinary skill in the art can readily implement the present invention with reference to the accompanying drawings. The present invention may be embodied in many different forms and is not limited to the embodiments set forth herein. In the drawings, parts unrelated to the description are omitted for clarity of description of the present invention, and throughout the specification, same or similar reference numerals denote same elements.

Terms and words used in the present specification and claims should not be construed as limited to their usual or dictionary definition. They should be interpreted as meaning and concepts consistent with the technical idea of the present invention, based on the principle that inventors may appropriately define the terms and concepts to describe their invention in the best way.

Accordingly, the embodiments described in the present specification and the configurations shown in the drawings correspond to preferred embodiments of the present invention, and do not represent all the technical idea of the present invention, so the configurations may have various examples of equivalent and modification that can replace them at the time of filing the present invention.

The term "energization" used below means that two or more members are connected to transmit an electrical signal or current. In an embodiment, the energization may be formed in a wired form by a wire member or the like or in a wireless form such as Wi-Fi, Bluetooth, RFID, or the like.

The term "communication" used in the following description means that two or more members are connected to each other so as to be in fluid communication. In an embodiment, communication may be formed by members such as a conduit or a pipe, or may be formed by opening the inside of each member to each other. In an embodiment, communication may mean that the inside of a specific member is formed to be open to allow fluid communication with the outside.

The term "fluid" used in the following description refers to any state of a material that can receive a transfer force and flow from one space to another. In an embodiment, the fluid may be in a liquid phase or a gas phase. In an embodiment, the fluid may be air or oxygen or the like.

The term "outflow" used in the following description refers to a state in which a fluid proceeds from one space to another space. In an embodiment, the outflow may mean a state in which a fluid flows outward from the inner space of the air blower 1. The outflow can be used interchangeably with "discharge."

The terms "upper side or above or upward", "lower side or below or downward", "front side", "rear side", "left" and "right" used in the following description will be understood with reference to the coordinate system shown in FIGS. 1 to 9.

In the following description, in order to clarify the features of the present invention, descriptions of some components may be omitted.

Referring to FIGS. 1 to 10, an air blower 1 according to an exemplary embodiment of the present invention is shown.

The air blower 1 according to an exemplary embodiment of the present invention may rotate about at least one axis in a three-axis coordinate system and discharge fluid into various spaces. Accordingly, the user can control the air blower 1 to easily discharge fluid in a desired direction.

In addition, the air blower 1 is configured to discharge fluid toward a plurality of paths. The plurality of paths rotate independently of each other, so that fluid can be discharged in different directions at the same time. Accordingly, the user can control the air blower 1 to simultaneously discharge fluid into a plurality of spaces.

Figure 2:
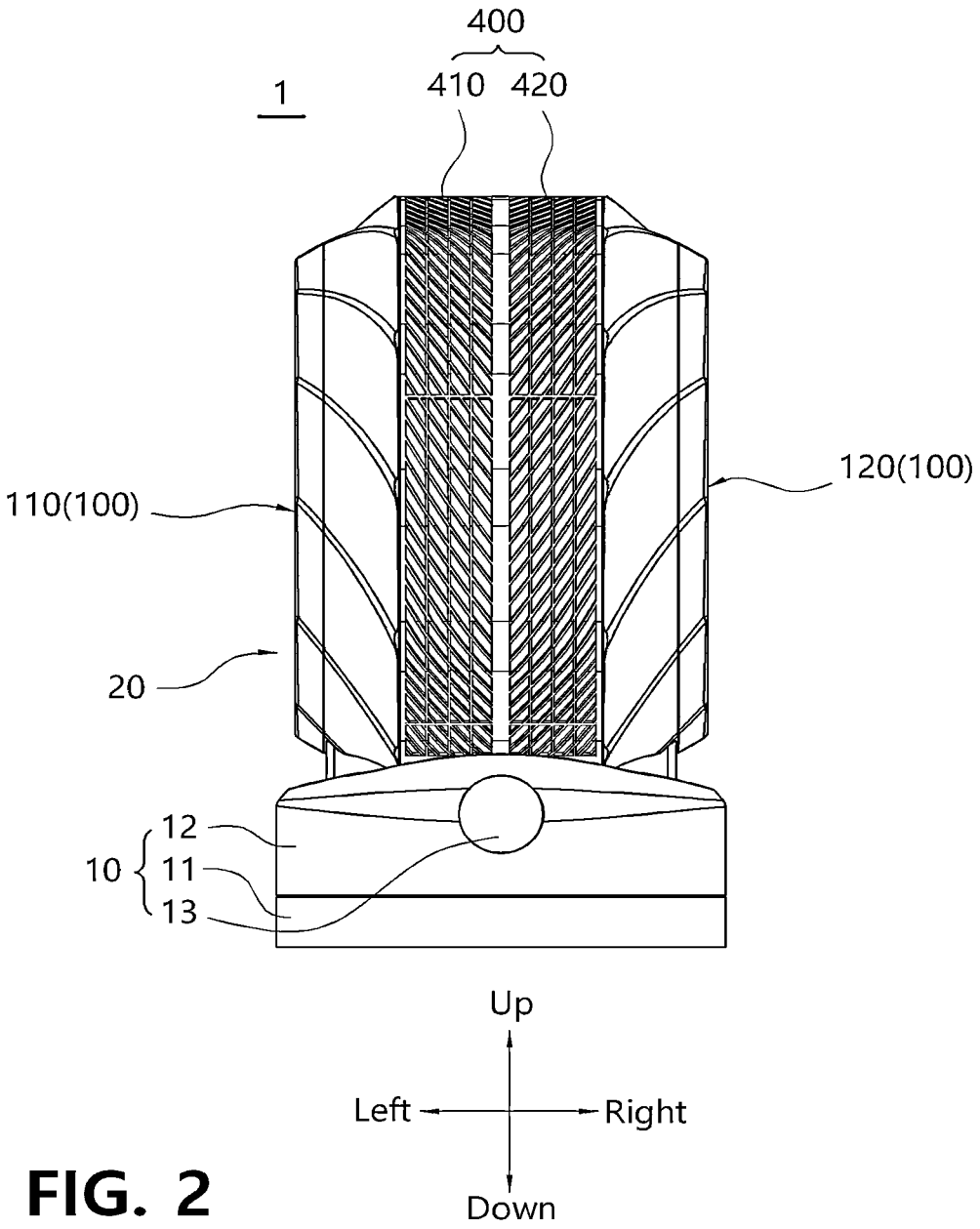
FIG. 2 is a front view illustrating the air blower of FIG. 1.
Figure 3:
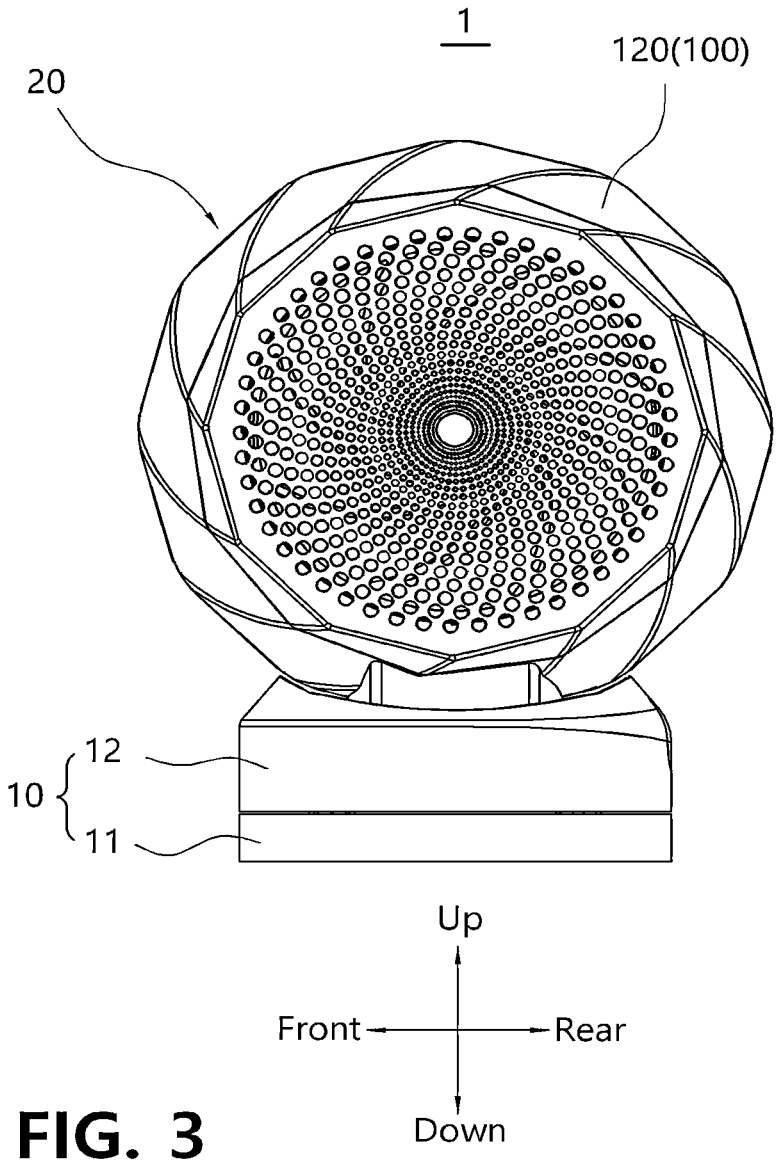
FIG. 3 is a side view illustrating the air blower of FIG. 1.

Referring to FIGS. 1 to 3, the air blower 1 according to the illustrated embodiment includes a neck unit 10 and a head unit 20.

The neck unit 10 forms one side of the air blower 1, i.e., the lower side in the illustrated embodiment. The neck unit 10 may be provided independently or may be provided supported by other members.

The neck unit 10 is coupled to the head unit 20. The neck unit 10 rotatably supports the head unit 20. To this end, a power member (not shown) such as a motor that rotatably supports the head unit 20 may be provided inside the neck unit 10.

The neck unit 10 may be formed of a lightweight yet highly rigid material. This is to prevent damage due to external impact while the user may easily move the air blower 1. In an embodiment, the neck unit 10 may be formed of a synthetic resin material such as reinforced plastic.

The neck unit 10 may have any shape capable of rotatably supporting the head unit 20. In the illustrated embodiment, the neck unit 10 has a cylindrical shape having a circular cross-section and having a height in the up-down direction.

The head unit 20 is rotatably coupled to one side of the neck unit 10 in the extension direction, i.e., the upper side in the illustrated embodiment. The other side of the neck unit 10 in the extension direction, i.e., the lower side in the illustrated embodiment, is supported by the ground or the surface of other members.

The neck unit 10 is energized with the outside. Specifically, a control unit (not shown), a power member (not shown) and the like accommodated in the neck unit 10 may receive power from an external power source (not shown). The control unit (not shown) is energizably connected to the head unit 20 so that a control signal for operating each component of the head unit 20 to be described later may be transmitted.

In the illustrated embodiment, the neck unit 10 includes a base 11, a seating member 12, and a manipulation unit 13.

The base 11 forms the other side of the neck unit 10, i.e., the lower side in the illustrated embodiment. The base 11 is a portion in which the neck unit 10 is in contact with the ground or other members. The base 11 is supported by the ground or the other members.

The base 11 is formed to have a predetermined height, i.e., a length in the up-down direction in the illustrated embodiment. The seating member 12 is coupled to one end of the base 11 in the height direction in the illustrated embodiment. The base 11 is rotatably coupled to the seating member 12.

The seating member 12 is rotatably coupled to the base 11 and may be rotated relative to the base 11. The seating member 12 is coupled to the one side of the base 11, i.e., the upper side in the illustrated embodiment.

The seating member 12 supports the head unit 20. The seating member 12 may be rotated together with the head unit 20 (see FIGS. 11 and 12). In the head unit 20 supported by the seating member 12, the scroll unit 500 therein may be rotated around one axis. This will be described later in detail.

One side where the seating member 12 is coupled to the base 11, i.e., the lower side in the illustrated embodiment, may be formed to have a circular cross-section. The other side where the seating member 12 supports the head unit 20, i.e., the upper side in the illustrated embodiment, may be formed such that the height of a radially inner side is lower than the height of a radially outer side. The head unit 20 may be accommodated and supported in the radially inner side, and the radially outer side may be formed to partially surround the supported head unit 20.

The shape of the seating member 12 may be any shape capable of stably supporting the head unit 20. In addition, the shape of the seating member 12 may be changed according to the shape of the head unit 20.

The manipulation unit 13 is operated by a user to receive a control signal for controlling the operation of the air blower 1. The manipulation unit 13 is energized with components of the control unit (not shown) and the head unit 20, and the air blower 1 may be operated according to an input control signal.

The manipulation unit 13 may be provided in any shape capable of receiving an input of a control signal from the user. In the illustrated embodiment, the manipulation unit 13 is provided in the form of a button that receives a control signal by being pressed. Alternatively, the manipulation unit 13 may be provided in the form of a dial that is rotated to receive a control signal, or a touch panel that is touched to receive a control signal.

The manipulation unit 13 is energized with the control unit (not shown). The control signal input through the manipulation unit 13 may be transmitted to the control unit (not shown) and utilized to control the operation of the neck unit 10 or the head unit 20.

The head unit 20 sucks in external fluid and discharges the sucked air in a direction desired by the user. The head unit 20 communicates with the outside. To this end, a plurality of through holes communicating the inside and the outside of the head unit 20 are formed through the outer circumferential surface of the head unit 20.

The head unit 20 is coupled to the neck unit 10. Specifically, the head unit 20 is rotatably supported by the neck unit 10. In the illustrated embodiment, the head unit 20 may be rotated clockwise or counterclockwise together with the seating member 12 around the up-down direction as the axis.

In the illustrated embodiment, the head unit 20 has a cylindrical shape with a height in the left-right direction and a circular cross-section. In this case, each end in the height direction, that is, the left end surface and the right end surface, are chamfered, and the diameter of each end surface may be formed smaller than the diameter of the other part. The head unit 20 may be coupled to the neck unit 10 and may have an arbitrary shape that may be rotated relative to the neck unit 10.

The head unit 20 according to an exemplary embodiment of the present invention may form various outflow passages 0.F for discharging the introduced fluid to the outside. In particular, the head unit 20 may discharge the fluid in different directions along the height direction, i.e., the left-right direction in the illustrated embodiment.

As described above, the head unit 20 may be rotated by the seating member 12 around the Z-axis, i.e., the up-down direction as the axis in the illustrated embodiment. Therefore, the outflow passage 0.F formed by the fluid discharged from the head unit 20 may also be rotated around the up-down direction as the axis.

As will be described later, as the scroll unit 500 provided inside the head unit 20 is operated, the outflow passage 0.F formed by the discharged fluid may rotate around the Y-axis, i.e., the left-right direction as the axis in the illustrated embodiment. It will be understood that the direction may be defined as the thickness or height direction of the head unit 20.

Accordingly, in the air blower 1 according to an exemplary embodiment of the present invention, the outflow passage 0.F may be formed to be rotatable with respect to at least one axis. As a result, fluid may be discharged over the entire space in which the air blower 1 according to an exemplary embodiment of the present invention is provided.

Referring back to FIGS. 1 to 5, the head unit 20 according to the illustrated embodiment includes a housing 100, a filter member 200, a fan member 300, a flow passage-forming member 400, and a scroll unit 500.

The housing 100 forms the outer shape of the head unit 20. The housing 100 forms a portion where the head unit 20 is exposed to the outside. In the illustrated embodiment, the housing 100 forms left and right portions of the head unit 20.

A space is formed inside the housing 100. The space communicates with the outside, so that external fluid may be introduced into the space of the housing 100. In addition, the fluid introduced into the space may flow out again to the outside.

Various components constituting the head unit 20 may be mounted in the space of the housing 100. In the illustrated embodiment, the filter member 200, the fan member 300, etc. may be accommodated in the space of the housing 100.

The housing 100 is coupled to the flow passage-forming member 400. The space of the housing 100 communicates with the inner space of the flow passage-forming member 400. The fluid introduced into the space of the housing 100 may flow out to the outside through the inner space of the flow passage-forming member 400. This will be described later in detail.

The housing 100 may have any shape capable of forming the outer shape of the head unit 20, allowing fluid to flow therein, and mounting components for the flow. In the illustrated embodiment, the housing 100 has a disc shape having a circular cross-section and having a thickness in the left-right direction.

A plurality of housings 100 may be provided. The plurality of housings 100 may be disposed at different positions to constitute different parts of the head unit 20, respectively. In the illustrated embodiment, the housing 100 includes a first housing 110 located on the left and a second housing 120 located on the right.

The first housing 110 forms one side in the height direction of the housing 100, i.e., the left side in the illustrated embodiment. The first housing 110 is coupled to the flow passage-forming member 400 while covering one side of the flow passage-forming member 400, i.e., the left side in the illustrated embodiment.

The first housing 110 may be formed such that the diameter of the cross-section decreases toward a direction opposite to the flow passage-forming member 400, i.e., the left side in the illustrated embodiment.

In the illustrated embodiment, the first housing 110 includes a first cover 111, a first filter support part 112, a first filter accommodation part 113, and a first vortex-forming member 114.

The first cover 111 forms the outermost side of the first housing 110, i.e., the left side in the illustrated embodiment. A plurality of through holes for communicating the inner space of the first housing 110 with the outside are formed through the first cover 111.

The first cover 111 is coupled to the first filter accommodation part 113. Specifically, the first cover 111 covers the first filter support part 112 and a first filter 210 accommodated in the first filter support part 112 and is coupled to the first filter accommodation part 113.

The first cover 111 may have any shape capable of forming the outside of the first housing 110 and communicating the internal space thereof with the outside. In the illustrated embodiment, the first cover 111 is formed to have a circular cross-section, but have an outer circumferential surface inclined so that the diameter increases in a direction toward the flow passage-forming member 400.

The first filter support part 112 is positioned between the first cover 111 and the first filter accommodation part 113.

The first filter support part 112 supports the first filter 210. A space for accommodating the first filter 210 is formed in the first filter support part 112. The first filter 210 may be retractably accommodated in the space.

The first filter support part 112 is coupled to the first filter accommodation part 113. Specifically, the first filter support part 112 is detachably accommodated in a space formed inside the first filter accommodation part 113.

The first filter support part 112 may be disposed to be covered by the first cover 111 and the first vortex-forming member 114. That is, referring to FIGS. 4 to 5, the first cover 111, the first vortex-forming member 114, the first filter support part 112, and the first filter accommodation part 113 are sequentially stacked.

The first filter support part 112 may have any shape that may be detachably coupled to the first filter 210. In the illustrated embodiment, the first filter support part 112 has a space formed therein having a circular cross-section and having a height in the left-right direction and is formed in a ring shape including a surface surrounding the outer circumference of the space.

The first filter support part 112 may be formed in a shape corresponding to the shape of the first filter 210 and the shape of the first filter accommodation part 113.

The first filter accommodation part 113 accommodates the first filter 210 and the first filter support part 112 supporting the first filter 210. A space for accommodating the first filter 210 and the first filter support part 112 is formed inside the first filter accommodation part 113.

The first filter accommodation part 113 is coupled to the first cover 111 and the first vortex-forming member 114. Specifically, the first cover 111 and the first vortex-forming member 114 cover the accommodated first filter 210 and the first filter support part 112 and are coupled to the first filter accommodation part 113.

In this case, the plurality of through holes formed through the first cover 111 may be disposed to overlap the first filter 210 along the coupling direction, i.e., the left-right direction in the illustrated embodiment. Accordingly, the air introduced into the first housing 110 through the plurality of through holes may flow into the flow passage-forming member 400 after being filtered through the first filter 210.

The first filter accommodation part 113 may have any shape capable of performing the above function. In the illustrated embodiment, the first filter accommodation part 113 is formed to have a circular cross-section, but have an outer circumferential surface inclined so that the diameter increases in a direction toward the flow passage-forming member 400.

In this case, the slope of the outer circumferential surface of the first filter accommodation part 113 may be the same as the slope of the outer circumferential surface of the first cover 111. Accordingly, when the first cover 111 and the first filter accommodation part 113 are combined, the outer circumferential surface thereof may be formed to have a certain slope.

Although not shown, a rail member (not shown) may be provided on one surface facing a first scroll **500*a* among surfaces of the first filter accommodation part 113, i.e., on the right surface in the illustrated embodiment. The rail member (not shown) may extend along a direction in which the outer circumference of the first filter accommodation part 113** extends.

That is, in the illustrated embodiment, on the radially outer side of a space in which the first filter 210 is accommodated and on the radially inner side of the outer circumference of the first filter accommodation part 113, the rail member (not shown) may be formed to extend in an annular shape to surround the space.

Roller members (not shown) rotatably coupled to the first scroll **500*a*, respectively, are seated on the rail member (not shown) to be rollable. The roller member (not shown) may be seated on the rail member (not shown) to be rollable on the radially inner side or radially outer side of the rail member (not shown). The roller member (not shown) and the first scroll 500*a*** may be rotated while moving along the rail member (not shown).

The first vortex-forming member 114 is positioned between the first cover 111 and the first filter accommodation part 113.

The first vortex-forming member 114 controls the flow of fluid introduced through the plurality of through holes of the first cover 111. By the first vortex-forming member 114, the fluid introduced is formed as a vortex, and the flow rate may be increased and the flow direction may be variously formed.

The first vortex-forming member 114 is rotatably provided. The first vortex-forming member 114 may be rotatably coupled to the first cover 111 and the first filter accommodation part 113.

A separate power member (not shown) may be provided for rotation of the first vortex-forming member 114. In an embodiment, the first vortex-forming member 114 may be coupled to a fan motor 330 to be described later and configured to rotate when the fan motor 330 is operated.

Among the above components of the first housing 110, the first filter support part 112 and the first vortex-forming member 114 are surrounded by the first cover 111 and the first filter accommodation part 113 and are not arbitrarily exposed to the outside.

Therefore, the first filter 210 supported by the first filter support part 112 is also not arbitrarily exposed to the outside. Accordingly, the first filter 210 may be protected from external impact or the like by the first filter support part 112.

Furthermore, the first vortex-forming member 114 provided to be rotatable is also not affected by external impact or the like. Accordingly, a safety accident caused by the rotation of the first vortex-forming member 114 may be prevented, and the rotating first vortex-forming member 114 is not damaged by an external member or the like.

The second housing 120 forms the other side in the height direction of the housing 100, i.e., the right side in the illustrated embodiment. The second housing 120 is coupled to the flow passage-forming member 400 while covering the other side of the flow passage-forming member 400, i.e., the right side in the illustrated embodiment.

The second housing 120 may be formed such that the diameter of the cross-section decreases toward a direction opposite to the flow passage-forming member 400, i.e., the right side in the illustrated embodiment.

In the illustrated embodiment, the second housing 120 includes a second cover 121, a second filter support part 122, a second filter accommodation part 123, and a second vortex-forming member 124.

The second cover 121 forms the outermost side of the second housing 120, i.e., the right side in the illustrated embodiment. A plurality of through holes for communicating the inner space of the second housing 120 with the outside are formed through the second cover 121.

The second cover 121 is coupled to the second filter accommodation part 123. Specifically, the second cover 121 covers the second filter support part 122 and a second filter 220 accommodated in the second filter support part 122 and is coupled to the second filter accommodation part 123.

The second cover 121 may have any shape capable of forming the outside of the second housing 120 and communicating the internal space thereof with the outside. In the illustrated embodiment, the second cover 121 is formed to have a circular cross-section, but have an outer circumferential surface inclined so that the diameter increases in a direction toward the flow passage-forming member 400.

The second filter support part 122 is positioned between the second cover 121 and the second filter accommodation part 123.

The second filter support part 122 supports the second filter 220. A space for accommodating the second filter 220 is formed in the second filter support part 122. The second filter 220 may be retractably accommodated in the space.

The second filter support part 122 is coupled to the second filter accommodation part 123. Specifically, the second filter support part 122 is detachably accommodated in a space formed inside the second filter accommodation part 123.

The second filter support part 122 may be disposed to be covered by the second cover 121 and the second vortex-forming member 124. That is, referring to FIGS. 4 to 5, the second cover 121, the second vortex-forming member 124, the second filter support part 122, and the second filter accommodation part 123 are sequentially stacked.

The second filter support part 122 may have any shape that may be detachably coupled to the second filter 220. In the illustrated embodiment, the second filter support part 122 has a space formed therein having a circular cross-section and having a height in the left-right direction and is formed in a ring shape including a surface surrounding the outer circumference of the space.

The second filter support part 122 may be formed in a shape corresponding to the shape of the second filter 220 and the shape of the second filter accommodation part 123.

The second filter accommodation part 123 accommodates the second filter 220 and the second filter support part 122 supporting the second filter 220. A space for accommodating the second filter 220 and the second filter support part 122 is formed inside the second filter accommodation part 123.

The second filter accommodation part 123 is coupled to the second cover 121 and the second vortex-forming member 124. Specifically, the second cover 121 and the second vortex-forming member 124 cover the accommodated second filter 220 and the second filter support part 122 and are coupled to the second filter accommodation part 123.

In this case, the plurality of through holes formed through the second cover 121 may be disposed to overlap the second filter 220 along the coupling direction, i.e., the left-right direction in the illustrated embodiment. Accordingly, the air introduced into the second housing 120 through the plurality of through holes may flow into the flow passage-forming member 400 after being filtered through the second filter 220.

The second filter accommodation part 123 may have any shape capable of performing the above function. In the illustrated embodiment, the second filter accommodation part 123 is formed to have a circular cross-section, but have an outer circumferential surface inclined so that the diameter increases in a direction toward the flow passage-forming member 400.

In this case, the slope of the outer circumferential surface of the second filter accommodation part 123 may be the same as the slope of the outer circumferential surface of the second cover 121. Accordingly, when the second cover 121 and the second filter accommodation part 123 are combined, the outer circumferential surface thereof may be formed to have a certain slope.

Although not shown, a rail member (not shown) may be also provided on one surface facing a second scroll **500*b* among surfaces of the second filter accommodation part 123, i.e., on the left surface in the illustrated embodiment. The rail member (not shown) may extend along a direction in which the outer circumference of the second filter accommodation part 123** extends.

That is, in the illustrated embodiment, on the radially outer side of a space in which the second filter 220 is accommodated and on the radially inner side of the outer circumference of the second filter accommodation part 123, the rail member (not shown) may be formed to extend in an annular shape to surround the space.

Roller members (not shown) rotatably coupled to the second scroll **500*b*, respectively, are seated on the rail member (not shown) to be rollable. The roller member (not shown) may be seated on the rail member (not shown) to be rollable on the radially inner side or radially outer side of the rail member (not shown). The roller member (not shown) and the second scroll 500*b*** may be rotated while moving along the rail member (not shown).

The second vortex-forming member 124 is positioned between the second cover 121 and the second filter accommodation part 123.

The second vortex-forming member 124 controls the flow of fluid introduced through the plurality of through holes of the second cover 121. By the second vortex-forming member 124, the fluid introduced is formed as a vortex, and the flow rate may be increased and the flow direction may be variously formed.

The second vortex-forming member 124 is rotatably provided. The second vortex-forming member 124 may be rotatably coupled to the second cover 121 and the second filter accommodation part 123.

A separate power member (not shown) may be provided for rotation of the second vortex-forming member 124. In an embodiment, the second vortex-forming member 124 may be coupled to a fan motor 330 to be described later and configured to rotate when the fan motor 330 is operated.

Among the above components of the second housing 120, the second filter support part 122 and the second vortex-forming member 124 are surrounded by the second cover 121 and the second filter accommodation part 123 and are not arbitrarily exposed to the outside.

Therefore, the second filter 220 supported by the second filter support part 122 is also not arbitrarily exposed to the outside. Accordingly, the second filter 220 may be protected from external impact or the like by the second filter support part 122.

Furthermore, the second vortex-forming member 124 provided to be rotatable is also not affected by external impact or the like. Accordingly, a safety accident caused by the rotation of the second vortex-forming member 124 may be prevented, and the rotating second vortex-forming member 124 is not damaged by an external member or the like.

The filter member 200 is configured to be coupled to the housing 100 to purify the fluid introduced into the inner space of the housing 100.

The filter member 200 may be provided in any form capable of purifying fluid. In an embodiment, the filter member 200 may be provided as an EPA filter, a HEPA filter, or an ULPA filter or the like.

The filter member 200 may be of any shape that can be coupled to and accommodated in the housing 100 to purify the incoming fluid. In the illustrated embodiment, the filter member 200 has a disc shape having a circular cross-section and having a thickness in the left-right direction. The shape of the filter member 200 may be changed according to the shapes of the filter support part 112, 122 and the filter accommodation part 113, 123.

A plurality of filter members 200 may be provided. The plurality of filter members 200 may be coupled to the first housing 110 and the second housing 120, respectively. In the illustrated embodiment, two filter members 200 are provided, including a first filter 210 and a second filter 220.

The first filter 210 is coupled to the first filter support part 112 and the first filter accommodation part 113 of the first housing 110. The first filter 210 is configured to purify the fluid introduced into the first housing 110.

The second filter 220 is coupled to the second filter support part 122 and the second filter accommodation part 123 of the second housing 120. The second filter 220 is configured to purify the fluid introduced into the second housing 120.

The fan member 300 operates according to the applied control signal and current to provide a transfer force for external fluid to flow into the inner space of the housing 100. In addition, the fan member 300 provides a transfer force for the fluid flowing into the inner space of the flow passage-forming member 400 through the inner space of the housing 100 to flow to the outside.

The fan member 300 is rotatably accommodated in the inner space of the flow passage-forming member 400. The fan member 300 may be rotatably provided with respect to the center of the flow passage-forming member 400 as the axis.

The fan member 300 may be provided in any shape that can provide a transfer force to the fluid. In the illustrated embodiment, the fan member 300 is provided as a sirocco fan including a plurality of blades 310. In the above embodiment, the fan member 300 has a cylindrical shape extending in its axial direction, i.e., the left-right direction in the illustrated embodiment.

The fan member 300 may be configured to suck fluid in one direction and discharge fluid in the other direction. In the illustrated embodiment, the fan member 300 is configured to suck fluid along its axial direction, i.e., the left-right direction. Additionally, the fan member 300 is configured to discharge fluid along its radial direction, i.e., in a direction facing radially outward with respect to the left-right direction above.

In the illustrated embodiment, the fan member 300 includes a blade 310, a rotation shaft 320, a fan motor 330, and a rotation support part 340.

The blade 310 forms a part of the outer circumference of the fan member 300. The blade 310 extends obliquely at a predetermined angle with respect to the outer circumferential surface of the fan member 300. When the fan member 300 is rotated, the blade 310 generates a transfer force for flowing a fluid by the shape.

A plurality of blades 310 may be formed. The plurality of blades 310 may be disposed to be spaced apart from each other along the outer circumference of the fan member 300. A space in which the plurality of blades 310 are formed to be spaced apart along the outer circumference of the fan member 300 is formed open, so that the inner space of the fan member 300 and the outside (i.e., here, the inner space of the flow passage-forming member 400) may communicate with each other.

Figure 6:
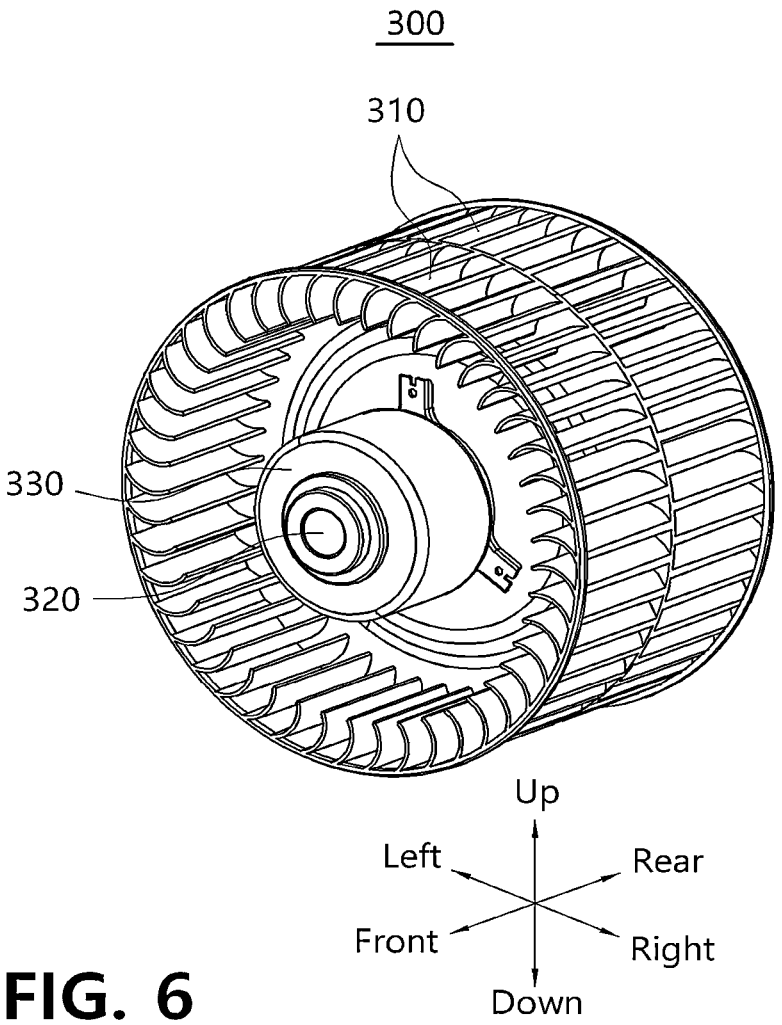
FIG. 6 is a perspective view illustrating a fan member provided in the air blower of FIG. 1.

In addition, the plurality of blades 310 may be provided in a plurality of rows. Referring to FIG. 6, the plurality of blades 310 include a first row located relatively on the left and a second row located relatively on the right.

In this case, a plurality of blades 310 formed in the first row and a plurality of blades 310 formed in the second row may be alternately arranged along the outer circumferential direction. That is, a plurality of blades 310 may be arranged in different shapes in the first row and the second row.

The rotation shaft 320 functions as a central axis for rotating the fan member 300. The rotation shaft 320 rotatably supports the fan member 300. The rotation shaft 320 may be rotatably coupled to the first filter accommodation part 113 or the second filter accommodation part 123.

The rotation shaft 320 is disposed on the same axis as the central axis of the fan member 300. In an embodiment, the rotation shaft 320 may be disposed on the same central axis as one or more of the housing 100, the filter member 200, the flow passage-forming member 400, and the scroll unit 500.

The rotation shaft 320 is coupled to the fan motor 330.

The fan motor 330 provides power to rotate the fan member 300. The fan motor 330 may be controlled to rotate clockwise or counterclockwise. Accordingly, the fan member 300 and the blade 310 may be rotated, thereby generating a transfer force and providing it to the fluid.

The fan motor 330 may be provided in any form capable of rotating the fan member 300. In the illustrated embodiment, the fan motor 330 is provided in the form of an electric motor coupled to the fan member 300. In the above embodiment, the fan motor 330 may be energized with the manipulation unit 13, the control unit (not shown), and an external power source (not shown).

The fan motor 330 is coupled to the filter accommodation part 113, 123. In the illustrated embodiment, a single fan motor 330 is provided and coupled to the first filter accommodation part 113 on the left side. Alternatively, the fan motor 330 may be coupled to the second filter accommodation part 123 on the right side.

When the fan motor 330 is rotated, the rotation shaft 320 coupled thereto may be rotated together so that the fan member 300 may be rotated.

The rotation support part 340 is coupled to the scroll unit 500 and rotates together. The rotation support part 340 forms a discharge path of the fluid introduced into the flow passage-forming member 400 by the fan member 300 together with the scroll unit 500.

Figure 4:
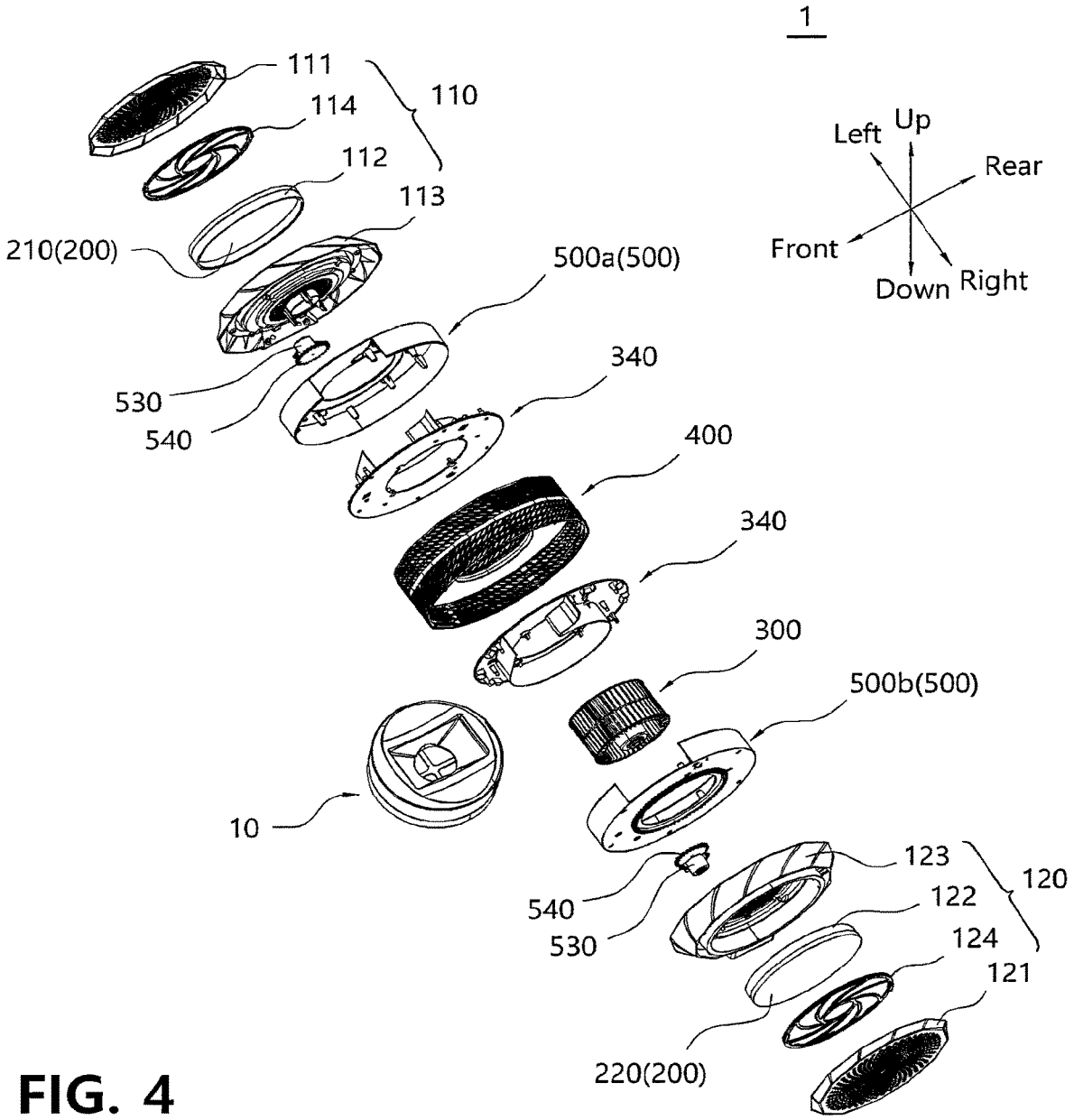
FIG. 4 is an exploded perspective view illustrating the air blower of FIG. 1.
Figure 5:
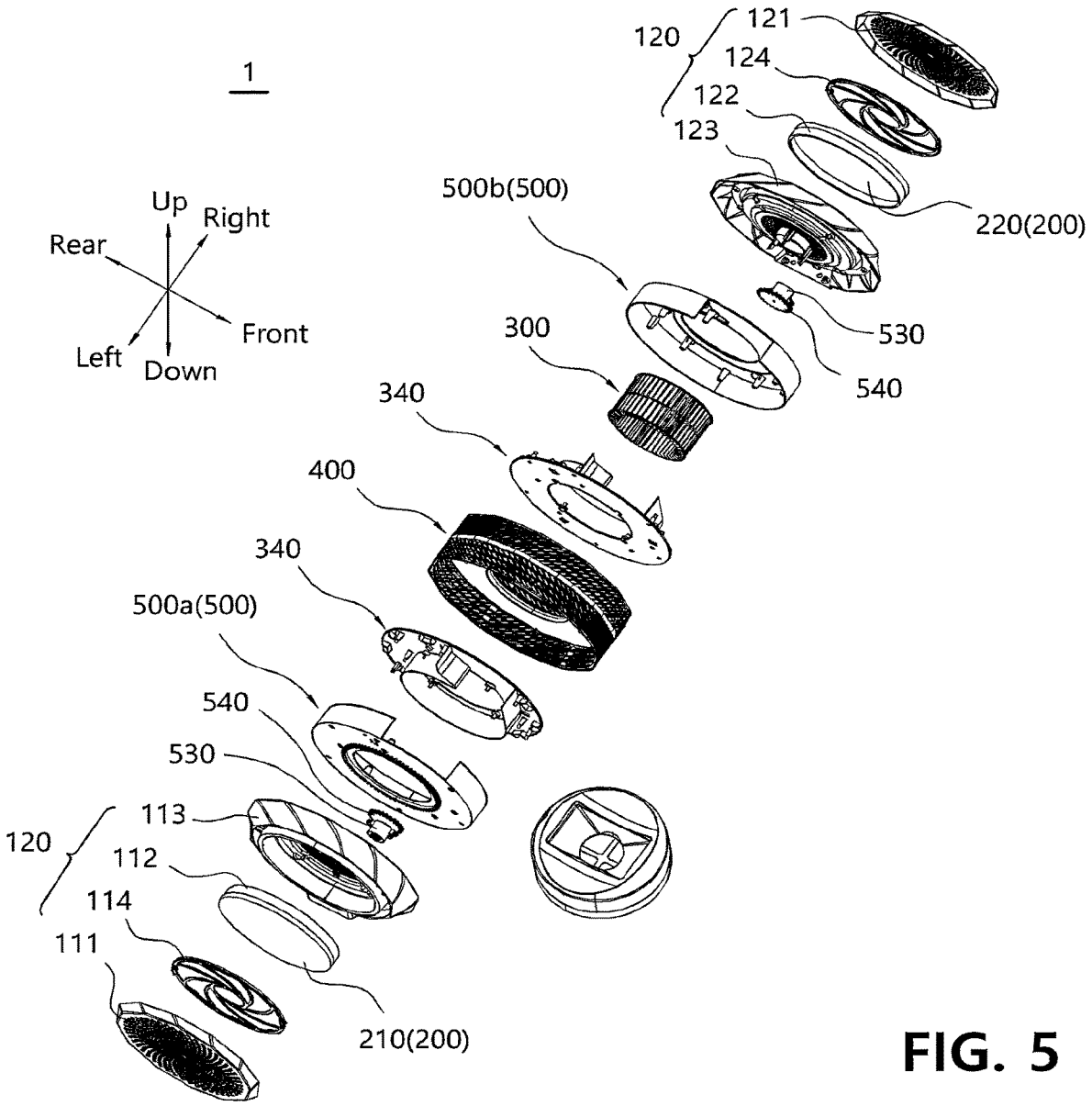
FIG. 5 is an exploded perspective view from another angle, illustrating the air blower of FIG. 1.

The rotation support part 340 is rotatably accommodated in a scroll accommodation part 411, 421 of the flow passage-forming member 400. The fan member 300 is rotatably accommodated in the hollow formed inside the rotation support part 340. That is, as shown in FIGS. 4 to 5, the fan member 300 is accommodated in a space formed through the inside of the rotation support part 340. The space communicates with the inner space of the flow passage-forming member 400 and the inner space of the housing 100.

The rotation support part 340 is rotatably accommodated in the flow passage-forming member 400. The rotation support part 340 is accommodated in a space formed inside the flow passage-forming member 400, specifically, in the scroll accommodation part 411, 421. The rotation support part 340 may be rotated together with the scroll unit 500 while being accommodated in the scroll accommodation part 411, 421.

The rotation support part 340 may have any shape that may be coupled to the scroll unit 500 and rotate together. In the illustrated embodiment, the rotation support part 340 has a circular cross-section and a thickness in the left-right direction, and has a ring shape with a hollow formed therethrough. As described above, the fan member 300 is rotatably accommodated in the hollow.

A plurality of rotation support parts 340 may be provided. The plurality of rotation support parts 340 may be respectively coupled to the scroll unit 500 at different positions.

In the illustrated embodiment, two rotation support parts 340 are provided, and are disposed on the left and right sides, respectively. The rotation support part 340 located on the left side is accommodated in a first scroll accommodation part 411 of the flow passage-forming member 400, and is coupled to a first scroll unit 500*a* to rotate together. The rotation support part 340 located on the right side is accommodated in a second scroll accommodation part 421 of the flow passage-forming member 400, and is coupled to a second scroll unit 500*b* to rotate together.

In addition, inner walls surrounding the hollow protrudes from one surface, facing the scroll unit 500, of the surfaces of the rotation support part 340, that is, from the left side surface of the rotation support part 340 located on the left side and the right side surface of the rotation support part 340 located on the right side in the embodiment shown in FIGS. 5 to 6. The inner wall is formed to extend toward the scroll unit 500, respectively.

A plurality of grooves may be formed on the one surface of the rotation support part 340, that is, the surface facing the scroll unit 500. A plurality of protrusions extending from a scroll body 510 toward the rotation support part 340 may be inserted into the grooves. Accordingly, the coupling state between the rotation support part 340 and the scroll unit 500 can be stably maintained.

In an embodiment, the sum of the extension lengths of each of the inner walls provided on the plurality of rotation support parts 340 may be greater than or equal to the height of the fan member 300, that is, the length in the left-right direction in the illustrated embodiment. In the above embodiment, the fan member 300 accommodated in the hollow formed inside the rotation support part 340 is not arbitrarily exposed to the outside.

The inner wall may be formed to be partially open along the outer circumferential direction thereof. The fluid flowing in the radial direction of the fan member 300 may sequentially pass through the open portion of the inner wall and a scroll through part 514 formed in the scroll unit 500 and flow out to the outside.

Therefore, it can be said that the rotation support part 340 is combined with the scroll unit 500 to form a fluid discharge flow path.

Although not shown, a roller member (not shown) may be provided on the rotation support part 340. The roller member (not shown) may be rotatably provided on an inner surface of the rotation support part 340, that is, one surface facing the flow passage-forming member 400.

The roller member (not shown) may protrude from the rotation support part 340 toward the flow passage-forming member 400 by a predetermined length. The roller member (not shown) may include a shaft part (not shown) directly coupled to the rotation support part 340 and a rolling part (not shown) rotatably coupled to an end of the shaft part (not shown).

In an embodiment, a bearing member may be provided on the rolling part (not shown), and the rolling part (not shown) and the shaft part (not shown) may be rotatably coupled to each other. That is, the shaft part (not shown) is not rotated irrespective of the rotation of the rolling part (not shown). In the above embodiment, the shaft part (not shown) may be screw-coupled to the rotation support part 340 by forming a thread on the outer circumference thereof.

The rolling part (not shown) may be formed in a cylindrical shape having an axis in the same direction as the scroll unit 500, i.e., an axis in the left-right direction in the illustrated embodiment. An annular groove recessed radially inward and extending along the outer circumference of the rolling part (not shown) may be formed on the outer circumference of the rolling part (not shown). In an embodiment, the annular groove may be located in the central portion of the rolling part (not shown) in the height direction.

A rail member (not shown) provided on a partition wall 430 of the flow passage-forming member 400 is inserted into the annular groove. The rolling part (not shown) may be rotated and moved along the rail member (not shown). Accordingly, the plurality of rotation support parts 340 and the first and second scrolls 500*a* and 500*b* coupled thereto, respectively, may also be rotated. As a result, the discharge flow passage of the fluid may be formed in various directions by the rotation.

A plurality of roller members (not shown) may be provided. The plurality of roller members (not shown) may be coupled to the rotation support part 340 and the rail member (not shown) at different positions, respectively. In an embodiment, the plurality of roller members (not shown) may be disposed radially inside the outer circumference of the rotation support part 340 to be spaced apart from each other along the outer circumferential direction of the rotation support part 340.

In the above embodiment, the distance between the plurality of roller members (not shown) and the center of the rotation support part 340 may be the same. In other words, a virtual line connecting the plurality of roller members (not shown) has an arc shape having the same center as the rotation support part 340.

The plurality of roller members (not shown) may be coupled to the rail member (not shown) on the radially inner side or radially outer side of the rail member (not shown). In an embodiment, the plurality of roller members (not shown) may be provided in two pairs spaced apart from each other in the radial direction of the rotation support part 340.

In the above embodiment, the plurality of roller members (not shown) may be coupled to each other on the radially inner side and the radially outer side of the rail member (not shown), respectively, so that the coupling state and rotation may be stably maintained and performed.

The flow passage-forming member 400 adjusts the flow direction of the fluid introduced from the outside and discharges the fluid to the outside. The flow passage-forming member 400 may communicate with the housing 100 to receive a fluid introduced from the outside. The flow passage-forming member 400 accommodates the fan member 300 therein, so that a transfer force for introducing or discharging a fluid may be transmitted to the fluid.

The flow passage-forming member 400 communicates with the outside. External fluid may be introduced into the inner space of the flow passage-forming member 400 through the inner space of the housing 100. The introduced fluid may be discharged to the outside of the flow passage-forming member 400.

The flow passage-forming member 400 may have an arbitrary shape through which a fluid is introduced therein and the introduced fluid is discharged to the outside. In the illustrated embodiment, the flow passage-forming member 400 is formed to have an annular cross-section with a hollow formed therein, and having a height in the thickness direction of the housing 100, i.e., in the left-right direction. It will be understood that the height direction of the flow passage-forming member 400 is the same as the axial direction of the fan motor 330.

The flow passage-forming member 400 is coupled to the housing 100. As described above, a plurality of housings 100 may be provided, including a first housing 110 and a second housing 120. Each end of the flow passage-forming member 400 in the extension direction may be coupled to the first housing 110 and the second housing 120, respectively.

In the illustrated embodiment, the left end of the flow passage-forming member 400 is coupled to the first housing 110. The right end of the flow passage-forming member 400 is coupled to the second housing 120.

The flow passage-forming member 400 is coupled to the fan member 300. Specifically, the fan member 300 is rotatably accommodated in a space formed inside the flow passage-forming member 400.

The flow passage-forming member 400 is coupled to the rotation support part 340 and the scroll unit 500. Specifically, a plurality of scroll units 500 coupled to the rotation support part 340 are respectively rotatably accommodated in the scroll accommodation parts 411 and 421 formed in the flow passage-forming member 400.

Although not shown, the flow passage-forming member 400 itself may be provided to be rotatable. That is, in the embodiment shown in FIGS. 4 and 5, the flow passage-forming member 400 may be provided to be rotatable around its axial direction, i.e., the left-right direction.

Figure 7:
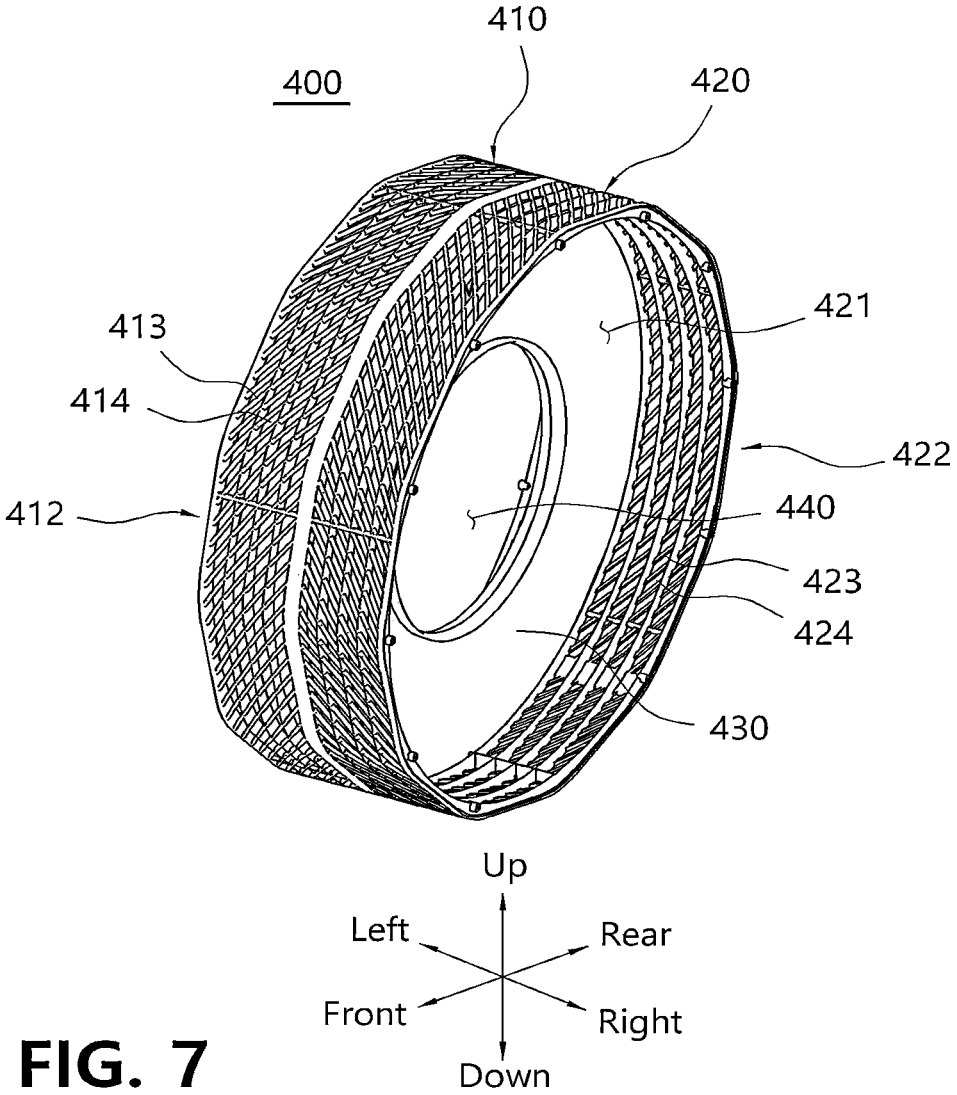
FIG. 7 is a perspective view illustrating a flow passage-forming member provided in the air blower of FIG. 1.
Figure 8:
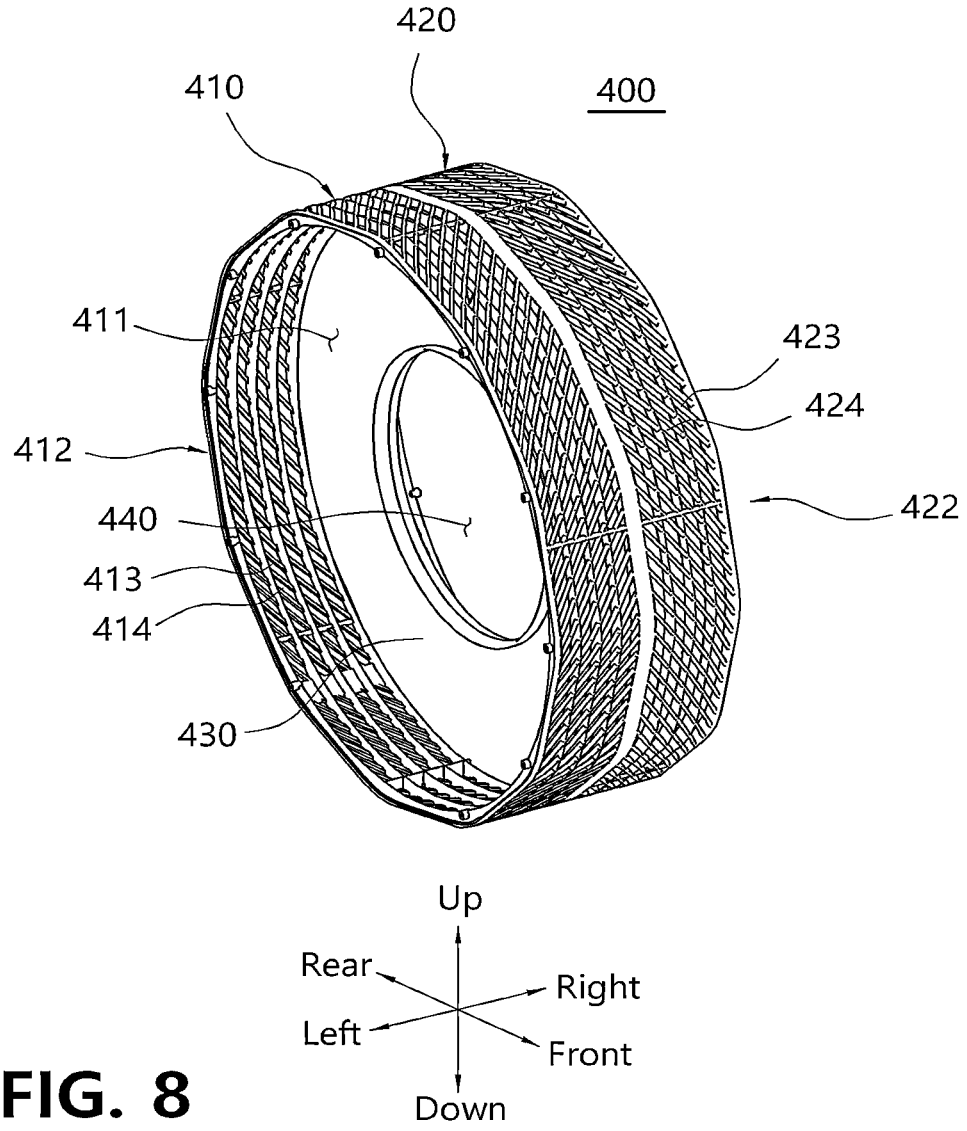
FIG. 8 is a perspective view from another angle, illustrating a flow passage-forming member provided in the air blower of FIG. 1.

In the embodiment illustrated in FIGS. 7 to 8, the flow passage-forming member 400 includes a first portion 410, a second portion 420, a partition wall 430, and a fan accommodation part 440.

The first portion 410 forms one side of the flow passage-forming member 400, i.e., the left side in the illustrated embodiment. The first portion 410 is continuous with the second portion 420. In the illustrated embodiment, the first portion 410 is formed to have a space formed therein and have an annular cross-section including an outer circumference surrounding the space.

In the illustrated embodiment, the first portion 410 includes a first scroll accommodation part 411, a first outer circumferential part 412, a first rib 413, and a first opening 414.

The first scroll accommodation part 411 is a space formed inside the first portion 410. The first scroll 500*a* of the scroll unit 500 and the rotation support part 340 coupled thereto (i.e., the rotation support part 340 on the left side in the illustrated embodiment) are rotatably accommodated in the first scroll accommodation part 411.

The first scroll accommodation part 411 may have a shape corresponding to the shape of the first portion 410. In the illustrated embodiment, the first scroll accommodation part 411 is defined as a cylindrical space having a circular cross-section and a height in the left-right direction. The shape of the first scroll accommodation part 411 may be changed according to the shape of the first scroll 500*a* and the rotation support part 340 coupled thereto.

The first scroll accommodation part 411 communicates with the outside. Specifically, the first scroll accommodation part 411 communicates with the fan accommodation part 440 in which the fan member 300 is accommodated. In addition, the first scroll accommodation part 411 communicates with the housing 100, specifically the internal space of the first housing 110. Furthermore, the first scroll accommodation part 411 communicates with the outside in the radial direction through the first opening 414 formed in the first outer circumferential part 412.

Accordingly, external fluid may be introduced into the inner space of the first housing 110, the first scroll accommodation part 411, and the fan accommodation part 440 and then pass through the first opening 414 and flow out to the outside again.

The first scroll accommodation part 411 is partially surrounded by the first outer circumferential part 412 and the partition wall 430. In the illustrated embodiment, the radially outer side of the first scroll accommodation part 411 is surrounded by the first outer circumferential part 412. In addition, the inner side of the first scroll accommodation part 411, i.e., the right side in the illustrated embodiment, is surrounded by the partition wall 430.

Therefore, the outer side of the first scroll accommodation part 411, i.e., the left side in the illustrated embodiment, are formed to be open. The rotation support part 340 and the first scroll 500*a* may be accommodated in the first scroll accommodation part 411 through the open outer side.

The first outer circumferential part 412 forms an outer circumference of the first portion 410. In the illustrated embodiment, since the first portion 410 has a cylindrical shape, it may be said that the first outer circumferential part 412 forms an outer circumferential surface or a side surface of the first portion 410.

The first outer circumferential part 412 partially surrounds the first scroll accommodation part 411. In the illustrated embodiment, the first outer circumferential part 412 is formed to surround the outer circumference of the first scroll accommodation part 411 from the radially outer side thereof. That is, the first scroll accommodation part 411 is located radially inside the first outer circumferential part 412.

A first rib 413 and a first opening 414 are formed in the first outer circumferential part 412.

The first rib 413 forms a portion of the first outer circumferential part 412. The first rib 413 is formed to partially cover the first scroll accommodation part 411 by extending in an arbitrary direction.

A plurality of first ribs 413 may be formed. The plurality of first ribs 413 may extend to be spaced apart from each other. The first scroll accommodation part 411 communicates with the outside in the radial direction by a space formed between the plurality of adjacent first ribs 413. The space may be defined as a first opening 414.

The plurality of first ribs 413 may extend obliquely by a predetermined angle. In the embodiment illustrated in FIGS. 7 to 8, a plurality of first ribs 413 extend obliquely and biasedly to the right with respect to the left end edge of the first outer circumferential part 412. The direction in which the plurality of first ribs 413 extend may be changed.

The first opening 414 communicates the first scroll accommodation part 411 with the outside. The fluid introduced into the flow passage-forming member 400 may flow out in the radial direction of the flow passage-forming member 400 through the first opening 414.

The first opening 414 forms another portion of the first outer circumferential part 412. The first opening 414 may be defined as a space in which the first ribs 413 adjacent to each other are spaced apart from each other.

As described above, a plurality of first ribs 413 may be formed. Accordingly, the first opening 414 may also be formed between a pair of first ribs 413 adjacent to each other among a plurality of first ribs 413.

The number and shape of the first openings 414 may be changed according to the number and shape of the first ribs 413.

The second portion 420 forms the other side of the flow passage-forming member 400, i.e., the right side in the illustrated embodiment. The second portion 420 is continuous with the first portion 410. In the illustrated embodiment, the second portion 420 is formed to have a space formed therein and have an annular cross-section including an outer circumference surrounding the space.

In the illustrated embodiment, the second portion 420 includes a second scroll accommodation part 421, a second outer circumferential part 422, a second rib 423, and a second opening 424.

The second scroll accommodation part 421 is a space formed inside the second portion 420. The second scroll 500*b* of the scroll unit 500 and the rotation support part 340 coupled thereto (i.e., the rotation support part 340 on the right side in the illustrated embodiment) are rotatably accommodated in the second scroll accommodation part 421.

The second scroll accommodation part 421 may have a shape corresponding to the shape of the second portion 420. In the illustrated embodiment, the second scroll accommodation part 421 is defined as a cylindrical space having a circular cross-section and a height in the left-right direction. The shape of the second scroll accommodation part 421 may be changed according to the shape of the second scroll 500*b* and the rotation support part 340 coupled thereto.

The second scroll accommodation part 421 communicates with the outside. Specifically, the second scroll accommodation part 421 communicates with the fan accommodation part 440 in which the fan member 300 is accommodated. In addition, the second scroll accommodation part 421 communicates with the housing 100, specifically the internal space of the second housing 120. Furthermore, the second scroll accommodation part 421 communicates with the outside in the radial direction through the second opening 424 formed in the second outer circumferential part 422.

Accordingly, external fluid may be introduced into the inner space of the second housing 120, the second scroll accommodation part 421, and the fan accommodation part 440 and then pass through the second opening 424 and flow out to the outside again.

The second scroll accommodation part 421 is partially surrounded by the second outer circumferential part 422 and the partition wall 430. In the illustrated embodiment, the radially outer side of the second scroll accommodation part 421 is surrounded by the second outer circumferential part 422. In addition, the inner side of the second scroll accommodation part 421, i.e., the left side in the illustrated embodiment, is surrounded by the partition wall 430.

Therefore, the outer side of the second scroll accommodation part 421, i.e., the right side in the illustrated embodiment, are formed to be open. The rotation support part 340 and the second scroll 500*b* may be accommodated in the second scroll accommodation part 421 through the open outer side.

The second outer circumferential part 422 forms an outer circumference of the second portion 420. In the illustrated embodiment, since the second portion 420 has a cylindrical shape, it may be said that the second outer circumferential part 422 forms an outer circumferential surface or a side surface of the second portion 420.

The second outer circumferential part 422 partially surrounds the second scroll accommodation part 421. In the illustrated embodiment, the second outer circumferential part 422 is formed to surround the outer circumference of the second scroll accommodation part 421 from the radially outer side thereof. That is, the second scroll accommodation part 421 is located radially inside the second outer circumferential part 422.

A second rib 423 and a second opening 424 are formed in the second outer circumferential part 422.

The second rib 423 forms a portion of the second outer circumferential part 422. The second rib 423 is formed to partially cover the second scroll accommodation part 421 by extending in an arbitrary direction.

A plurality of second ribs 423 may be formed. The plurality of second ribs 423 may extend to be spaced apart from each other. The second scroll accommodation part 421 communicates with the outside in the radial direction by a space formed between the plurality of adjacent second ribs 423. The space may be defined as a second opening 424.

The plurality of second ribs 423 may extend obliquely by a predetermined angle. In the embodiment illustrated in FIGS. 7 to 8, a plurality of second ribs 423 extend obliquely and biasedly to the left with respect to the right end edge of the second outer circumferential part 422. The direction in which the plurality of second ribs 423 extend may be changed.

That is, the first rib 413 and the second rib 423 are formed to extend in different directions. Accordingly, the outflow passage 0.F passing through the first portion 410 of the flow passage-forming member 400 and the outflow passage 0.F passing through the second portion 420 may extend in different directions.

The second opening 424 communicates the second scroll accommodation part 421 with the outside. The fluid introduced into the flow passage-forming member 400 may flow out in the radial direction of the flow passage-forming member 400 through the second opening 424.

The second opening 424 forms another portion of the second outer circumferential part 422. The second opening 424 may be defined as a space in which the second ribs 423 adjacent to each other are spaced apart from each other.

As described above, a plurality of second ribs 423 may be formed. Accordingly, the second opening 424 may also be formed between a pair of second ribs 423 adjacent to each other among a plurality of second ribs 423.

The number and shape of the second openings 424 may be changed according to the number and shape of the second ribs 423.

The partition wall 430 is coupled to the first portion 410 and the second portion 420, respectively. The partition wall 430 partitions the first scroll accommodation part 411 and the second scroll accommodation part 421. Accordingly, the rotation of the first scroll 500*a* accommodated in the first scroll accommodation part 411 and the second scroll 500*b* accommodated in the second scroll accommodation part 421 do not affect each other.

The partition wall 430 may be formed in a shape corresponding to the shape of the flow passage-forming member 400. In the illustrated embodiment, the partition wall 430 has a plate shape having an annular cross-section with a hollow formed therein and having a thickness in the left-right direction. The partition wall 430 may have any shape in which the fan member 300 is rotatably coupled thereto, and a plurality of scroll accommodation parts 411 and 421 may be partitioned.

Although not shown, a rail member (not shown) may also be provided on each surface of the partition wall 430. The partition wall 430 is positioned between the first scroll accommodation part 411 and the second scroll accommodation part 421 to partition them. Thus, the rail member (not shown) may be provided on each surface of the partition wall 430 facing each other, i.e., on both left and right surfaces in the illustrated embodiment.

The rail member (not shown) may extend along a direction in which the first outer circumferential part 412 and the second outer circumferential part 422 extend. That is, in the illustrated embodiment, the rail member (not shown) may be formed to extend in an annular shape to surround the fan accommodation part 440 in the radially outer side of the fan accommodation part 440 and in the radially inner side of the outer circumferential parts 412 and 422. The rail member (not shown) may be positioned to be biased radially outward adjacent to the first outer circumferential part 412 and the second outer circumferential part 422.

Roller members (not shown) rotatably coupled to the rotation support part 340, respectively, are seated on the rail member (not shown) to be rollable. The roller member (not shown) may be seated on the rail member (not shown) to be rollable on the radially inner side or radially outer side of the rail member (not shown). The roller member (not shown) and the rotation support part 340 may be rotated while moving along the rail member (not shown).

The fan accommodation part 440 is formed through the inside of the partition wall 430.

The fan accommodation part 440 is a space in which the fan member 300 is coupled to the flow passage-forming member 400. The fan member 300 may be rotatably accommodated in the fan accommodation part 440.

The fan accommodation part 440 is formed inside the flow passage-forming member 400. Specifically, the fan accommodation part 440 is formed through the inside of the partition wall 430 in its thickness direction, i.e., in the left-right direction in the illustrated embodiment.

The fan accommodation part 440 may have any shape capable of rotatably accommodating the fan member 300. In the illustrated embodiment, the fan accommodation part 440 is formed to have a circular cross-section. In this case, the diameter of the cross-section of the fan accommodation part 440 may be greater than or equal to the diameter of the cross-section of the fan member 300.

The fan accommodation part 440 communicates with the scroll accommodation parts 411 and 421. The fluid introduced into the scroll accommodation parts 411 and 421 may flow into the fan accommodation part 440 and the fan member 300 accommodated therein.

The fan accommodation part 440 communicates with the openings 414 and 424. The fluid flowing into the fan accommodation part 440 may flow out to the outside through the openings 414 and 424.

The scroll unit 500 forms a part of an outflow path of fluid introduced into the flow passage-forming member 400. The scroll unit 500 may be rotatably provided to form various fluid outflow paths.

The scroll unit 500 is coupled to the flow passage-forming member 400. Specifically, the scroll unit 500 is rotatably accommodated in a scroll accommodation part 411, 421 of the flow passage-forming member 400.

The scroll unit 500 communicates with the flow passage-forming member 400. Specifically, the scroll unit 500 communicates with the scroll accommodation parts 411 and 421 and the fan accommodation part 440 of the flow passage-forming member 400, respectively. The fluid introduced into the flow passage-forming member 400 from the outside may flow into the scroll unit 500.

The scroll unit 500 is coupled to the rotation support part 340. The scroll unit 500 may be rotated together with the rotation support part 340 to form various discharge flow paths of fluid.

The scroll unit 500 may be disposed to be covered by the housing 100. That is, in the embodiment illustrated in FIGS. 4 to 5, the outer side of the scroll unit 500 is covered by the first housing 110 and the second housing 120, so that it is not arbitrarily exposed to the outside. Accordingly, a safety accident caused by the rotating scroll unit 500 may be prevented.

A plurality of scroll units 500 may be provided. The plurality of scroll units 500 may be rotatably accommodated in a plurality of scroll accommodation parts 411 and 421, respectively. In addition, the plurality of scroll units 500 may be combined with the plurality of rotation support parts 340, respectively.

Specifically, in the illustrated embodiment, the first scroll 500*a* positioned biased to the left may be coupled to the rotation support part 340 positioned to the left and rotated together. In addition, the second scroll 500*b* positioned biased to the right may be coupled to the rotation support part 340 positioned to the right and rotated together.

In the illustrated embodiment, two scroll units 500 are provided, including a first scroll 500*a* accommodated in the first scroll accommodation part 411 and a second scroll 500*b* accommodated in the second scroll accommodation part 421.

In the above embodiment, the first scroll 500*a* and the second scroll 500*b* may be controlled to rotate independently or dependently on each other. That is, the first scroll 500*a* and the second scroll 500*b* may be controlled, respectively, or the operation methods thereof may be synchronized.

Accordingly, the outflow passage 0.F of the fluid may extend in different directions depending on the scrolls 500*a* and 500*b* passing therethrough among the first scroll 500*a* and the second scroll 500*b*. This will be described later in detail.

In addition, the first scroll 500*a* and the second scroll 500*b* have some differences in their combined positions, but the structure and function are the same, and thus, the corresponding contents will be collectively described below as the scroll unit 500.

Figure 9:
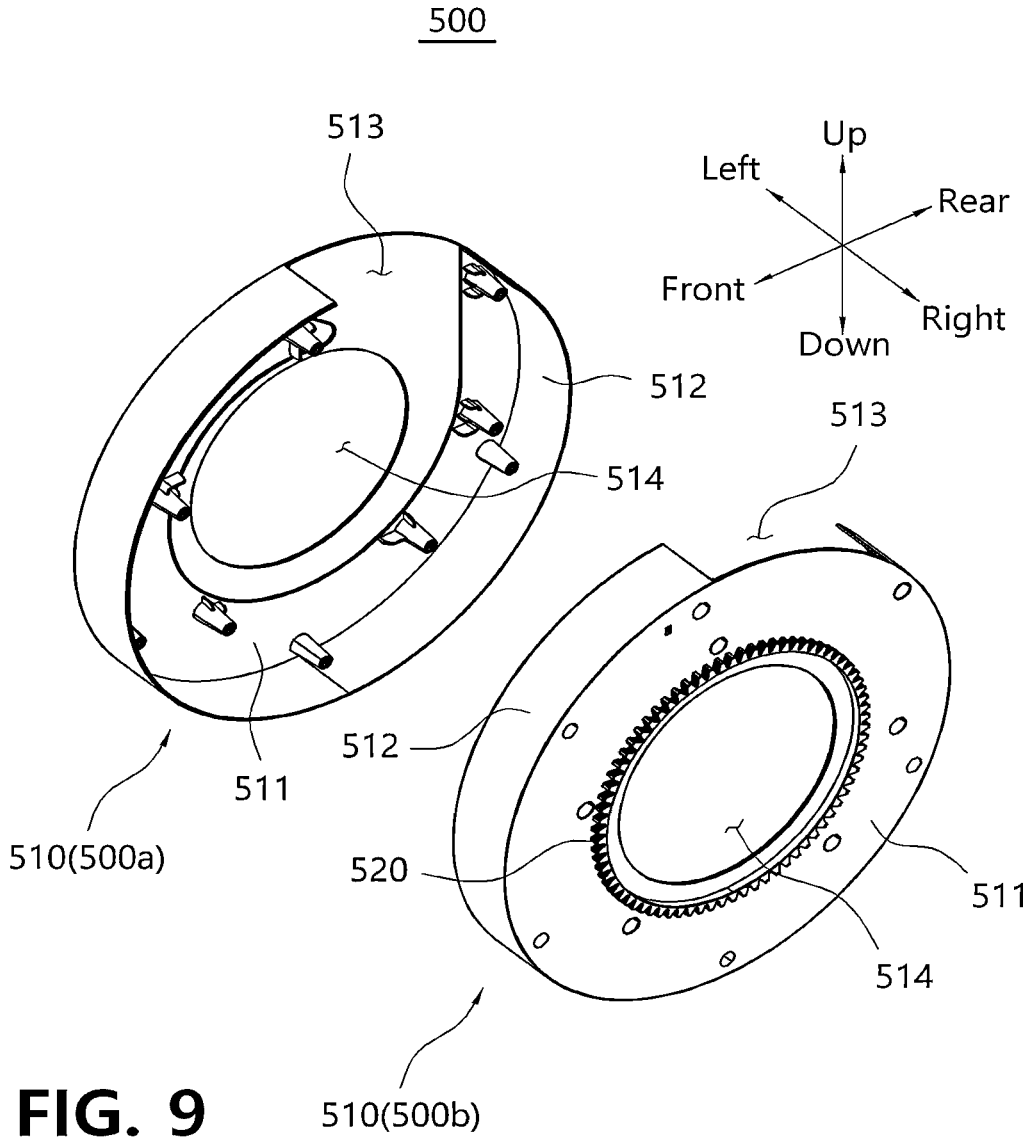
FIG. 9 is a perspective view illustrating a scroll unit provided in the air blower of FIG. 1.
Figure 10:
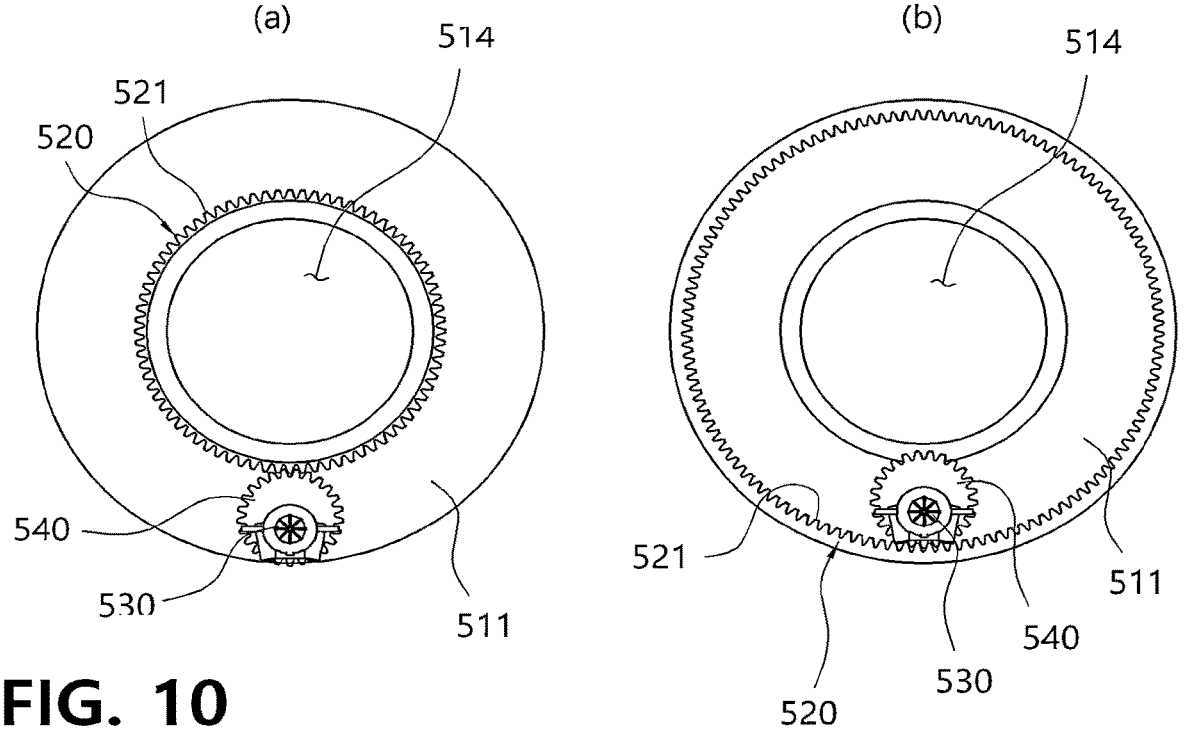
FIG. 10 is a side view illustrating a scroll unit provided in the air blower of FIG. 1 and a scroll unit according to a modified example.

In an embodiment shown in FIGS. 9 to 10, the scroll unit 500 includes a scroll body 510, a scroll gear 520, a scroll motor 530, and a driving gear 540.

The scroll body 510 forms an outer shape of the scroll unit 500. The scroll body 510 is rotatably accommodated in the scroll accommodation part 411, 421.

The scroll body 510 is coupled to the rotation support part 340. To this end, a plurality of protrusions extending toward the rotation support part 340 may be provided in the scroll body 510. The plurality of protrusions may be respectively inserted into a plurality of grooves formed on one surface of the rotation support part 340 facing the scroll body 510. Accordingly, the rotation support part 340 and the scroll unit 500 may be coupled and rotated together.

The scroll body 510 may be rotatably accommodated in the scroll accommodation part 411, 421 together with the rotation support part 340. The scroll body 510 may be coupled to the rotation support part 340 and rotated together.

A hollow is formed inside the scroll body 510. The fan member 300 may be rotatably accommodated in the hollow. As will be described later, the hollow may be defined as a scroll through part 514.

The scroll body 510 may have any shape that may be coupled to the rotation support part 340 and rotatably accommodated in the scroll accommodation part 411, 421. In the illustrated embodiment, the scroll body 510 is formed to have an annular cross-section having a hollow formed therein.

In the illustrated embodiment, the scroll body 510 includes a plate member 511, a scroll outer circumferential part 512, a scroll opening 513, and a scroll through part 514.

The plate member 511 forms a base of the scroll body 510. The plate member 511 forms a part of the scroll body 510. In the illustrated embodiment, the plate member 511 forms the outer side of the scroll body 510, that is, the left side of the first scroll 500*a* and the right side of the second scroll 500*b*.

The plate member 511 may be formed to correspond to the cross-sectional shape of the scroll body 510. In addition, the plate member 511 may be formed to correspond to the shape of the scroll accommodation part 411, 421. In the illustrated embodiment, the plate member 511 is formed in an annular shape having a scroll through part 514 formed therein.

A member for coupling the scroll body 510 to the rotation support part 340 may be provided in the plate member 511. In the illustrated embodiment, a plurality of columns extending toward one side facing the rotation support part 340 and each including a groove recessed therein are provided in the plate member 511. As described above, a plurality of protrusions extending from the rotation support part 340 may be inserted into the grooves, respectively.

Although not shown, a roller member (not shown) may be provided on the plate member 511. The roller member (not shown) may be rotatably coupled to the outer surface of the plate member 511, that is, the left surface of the plate member 511 of the first scroll 500*a* and the right surface of the plate member 511 of the second scroll 500*b*.

The roller member (not shown) may protrude from the plate member 511 toward the outside by a predetermined length. The roller member (not shown) may include a shaft part (not shown) directly coupled to the plate member 511 and a rolling part (not shown) rotatably coupled to an end of the shaft part (not shown).

In an embodiment, a bearing member may be provided on the rolling part (not shown), and the rolling part (not shown) and the shaft part (not shown) may be rotatably coupled to each other. That is, the shaft part (not shown) is not rotated irrespective of the rotation of the rolling part (not shown). In the above embodiment, the shaft part (not shown) may be screw-coupled to the plate member 511 by forming a thread on the outer circumference thereof.

The rolling part (not shown) may be formed in a cylindrical shape having an axis in the same direction as the scroll unit 500, i.e., an axis in the left-right direction in the illustrated embodiment. An annular groove recessed radially inward and extending along the outer circumference of the rolling part (not shown) may be formed on the outer circumference of the rolling part (not shown). In an embodiment, the annular groove may be located in the central portion of the rolling part (not shown) in the height direction.

The rail member (not shown) provided in the filter accommodation part 113, 123 is inserted into the annular groove. The rolling part (not shown) may be rotated and moved along the rail member (not shown). Accordingly, the first and second scrolls 500*a* and 500*b* and a plurality of rotation support parts 340 respectively coupled thereto may also be rotated. As a result, the discharge flow passage of the fluid may be formed in various directions by the rotation.

A plurality of roller members (not shown) may be provided. The plurality of roller members (not shown) may be coupled to the plate member 511 and the rail member (not shown) at different positions, respectively. In an embodiment, the plurality of roller members (not shown) may be disposed radially inside the scroll outer circumferential part 512 to be spaced apart from each other along the outer circumferential direction of the plate member 511.

In the above embodiment, the distance between the plurality of roller members (not shown) and the center of the plate member 511 may be the same. In other words, a virtual line connecting the plurality of roller members (not shown) has an arc shape having the same center as the plate member 511.

The plurality of roller members (not shown) may be coupled to the rail member (not shown) on the radially inner side or radially outer side of the rail member (not shown). In an embodiment, the plurality of roller members (not shown) may be provided in two pairs spaced apart from each other in the radial direction of the plate member 511.

In the above embodiment, the plurality of roller members (not shown) may be coupled to each other on the radially inner side and the radially outer side of the rail member (not shown), respectively, so that the coupling state and rotation may be stably maintained and performed.

The plate member 511 is continuous with the scroll outer circumferential part 512.

The scroll outer circumferential part 512 is continuous along the outer circumference of the plate member 511. The scroll outer circumferential part 512 extends inward, that is, toward the right side in the case of the first scroll 500*a* and the left side in the case of the second scroll 500*b*. An end of the scroll outer circumferential part 512 may be in contact with the rotation support part 340.

A scroll opening 513 is formed on the scroll outer circumferential part 512.

The scroll opening 513 communicates the inner space of the scroll unit 500 with the outside. The fluid introduced into the inner space of the scroll unit 500 may be discharged to the outside through the scroll opening 513.

The scroll opening 513 is formed on the scroll outer circumferential part 512. The scroll opening 513 is formed through the scroll outer circumferential part 512 in the thickness direction, i.e., in the radial direction in the illustrated embodiment.

The scroll opening 513 may extend along the outer circumferential direction of the scroll unit 500 by a predetermined length. That is, in the embodiment shown in FIG. 9, the scroll opening 513 is extended to be shorter than the extension length of the scroll outer circumferential part 512. The extension length of the scroll opening 513 may be changed according to the flow rate and speed of the fluid flowing out.

As described above, the scroll unit 500 is rotatably coupled to the flow passage-forming member 400. Therefore, the scroll opening 513 may also be rotated together, so that a relative position inside the flow passage-forming member 400 may be changed. Accordingly, the position and direction of the outflow passage 0.F formed by the scroll opening 513 may also be changed.

The scroll through part 514 is formed through the inside of the plate member 511. The fan member 300 is rotatably accommodated in the scroll through part 514.

The scroll through part 514 is formed to have a cross-section having a predetermined diameter. The diameter of the cross-section of the scroll through part 514 may be greater than the outer diameter of the cross-section of the fan member 300. Accordingly, the scroll unit 500 and the fan member 300 may be rotated independently with respect to each other.

In an embodiment, the scroll through part 514 may have the same central axis as the fan member 300.

The scroll gear 520 receives the driving force formed by the scroll motor 530. As the scroll motor 530 is operated, the scroll unit 500 may be rotated by the scroll gear 520.

The scroll gear 520 may be gear-fitted with the driving gear 540. The scroll gear 520 may be coupled to the driving gear 540 in various forms, and a detailed description thereof will be described later.

In the illustrated embodiment, the scroll gear 520 includes a toothing part 521. The toothing part 521 includes a plurality of concave portions and a plurality of convex portions. The plurality of concave portions and the plurality of convex portions are alternately continuous with each other in the extension direction of the scroll gear 520.

A plurality of scroll gears 520 may be provided. The plurality of scroll gears 520 may be coupled to a plurality of scroll bodies 510 and driving gears 540, respectively. In the illustrated embodiment, two scroll gears 520 are provided.

In the above embodiment, any one of the scroll gears 520 is coupled to the first scroll 500*a*, and the driving gear 540 located on the left side, respectively. The other scroll gear 520 is coupled to the second scroll 500*b*, and the driving gear 540 located on the right side, respectively.

The scroll motor 530 generates power for rotating the scroll unit 500. Power (i.e., rotational force) generated by the scroll motor 530 may be transmitted to the scroll gear 520 through the driving gear 540. The scroll motor 530 may be coupled to the filter accommodation part 113, 123 of the housing 100.

A plurality of scroll motors 530 may be provided. The plurality of scroll motors 530 may be coupled to a plurality of driving gears 540 and a plurality of filter accommodation parts 113 and 123, respectively. In the illustrated embodiment, two scroll motors 530 are provided. The left scroll motor 530 provided in the first scroll 500*a* is coupled to the first filter accommodation part 113. The right scroll motor 530 provided in the second scroll 500*b* is coupled to the second filter accommodation part 123.

In the above embodiment, any one scroll motor 530 is coupled to any one of the plurality of driving gears 540. In addition, the other scroll motor 530 is coupled to the other one of the plurality of driving gears 540.

The operating status, operating speed, operating direction, and the like of the plurality of scroll motors 530 may be controlled independently of each other. Accordingly, the first scroll 500*a* and the second scroll 500*b* respectively coupled to the plurality of scroll motors 530 may be operated independently of each other.

The scroll motor 530 is coupled to the driving gear 540.

The driving gear 540 transmits the driving force generated by the scroll motor 530 to the scroll body 510. The driving gear 540 is coupled to the scroll motor 530. In addition, the driving gear 540 is gear-fitted with the scroll gear 520.

The driving gear 540 and the scroll gear 520 may be gear-fitted in various forms. In the embodiment shown in FIG. 10(*a*), the scroll gear 520 is circumscribed with the driving gear 540. That is, in the above embodiment, the toothing part 521 of the scroll gear 520 extends along the outer circumference of the scroll gear 520.

In the embodiment shown in FIG. 10(*b*), the scroll gear 520 is inscribed with the driving gear 540. That is, in the above embodiment, the toothing part 521 of the scroll gear 520 extends along the inner circumference of the scroll gear 520.

In addition to the illustrated examples, it will be understood that the scroll gear 520 may be gear-fitted with the driving gear 540 in various forms.

The air blower 1 according to an exemplary embodiment of the present invention is in communication with the outside so that fluid can be introduced. The introduced fluid may flow out toward the outside again in various forms.

In this case, the air blower 1 is provided with a scroll unit 500 provided to be rotatable. A scroll outer circumferential part 512 and a scroll opening 513 penetrating the scroll outer circumferential part 512 to communicate the inside and the outside of the air blower 1 are formed in the scroll unit 500. As the scroll unit 500 is rotated, relative positions of the scroll outer circumferential part 512 and the scroll opening 513 may be changed.

As a result, the direction and angle of the path through which the air introduced into the air blower 1 flows out to the outside may be changed.

Hereinafter, the inflow passage 1.F and the outflow passage 0.F formed by the air blower 1 according to the embodiment of the present invention will be described in detail with reference to FIGS. 11 to 12.

Figure 11:
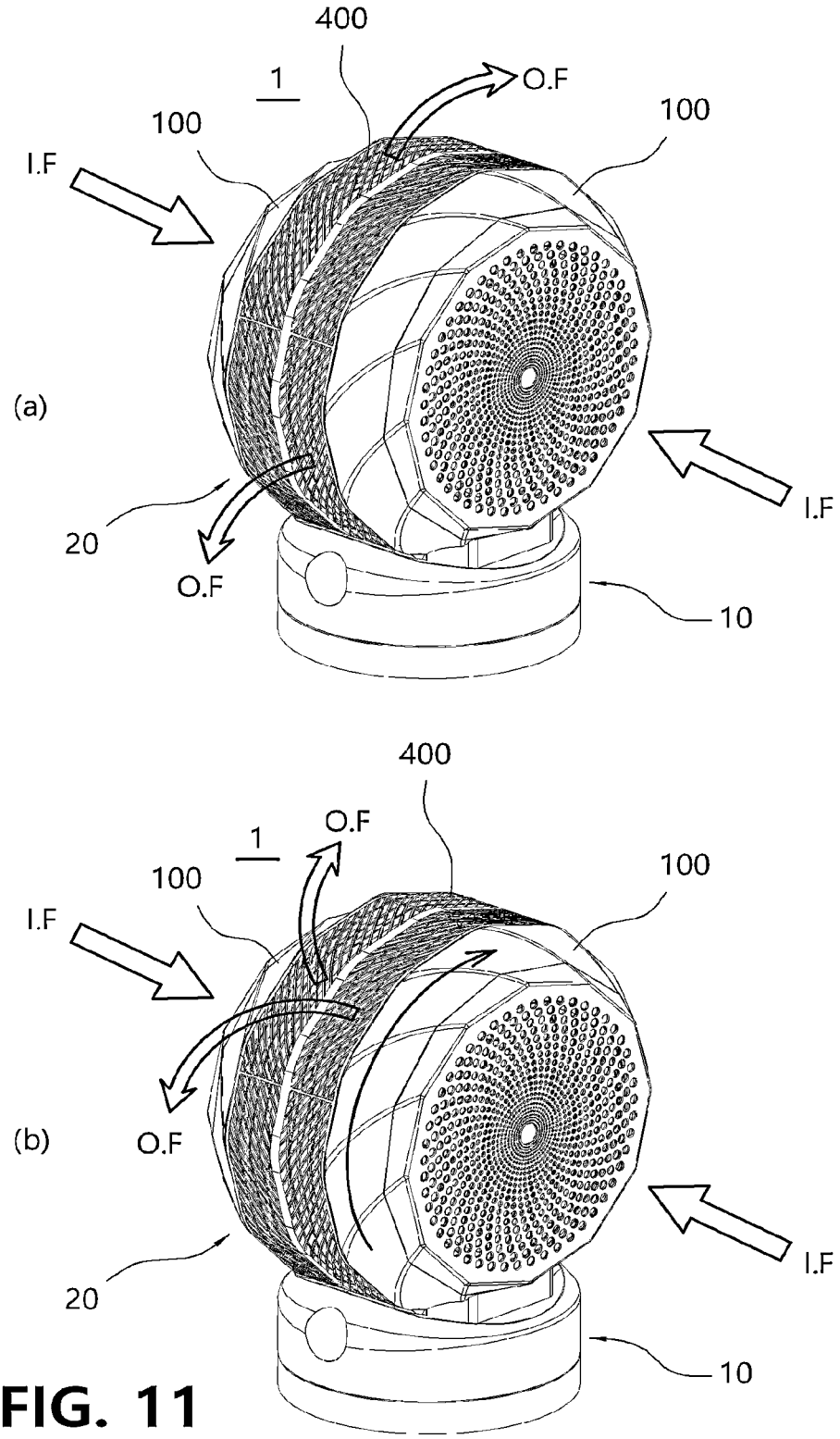
FIG. 11 is a perspective view illustrating an example in which an air flow path is changed by rotating the scroll unit of the air blower of FIG. 1.

Referring to FIG. 11, an example of an inflow passage 1.F and an outflow passage 0.F formed by an air blower 1 according to an exemplary embodiment of the present invention is illustrated.

As described above, a plurality of through holes are formed in the covers 111 and 121 of the housing 100. The inner space of the housing 100 communicates with the outside through the through hole. The inner space of the housing 100 communicates with the inner space of the flow passage-forming member 400.

When the fan member 300 accommodated in the inner space of the flow passage-forming member 400 is operated, a transfer force for suctioning external air is generated. By the transfer force, the fluid outside the air blower 1 flows to the inner space of the flow passage-forming member 400.

Referring to FIG. 11(*a*), the inflow passage 1.F extends into the air blower 1 while forming a predetermined angle with respect to the covers 111 and 121 of the housing 100. In an embodiment, the predetermined angle may be a right angle.

Meanwhile, the inner space of the flow passage-forming member 400 communicates with the outside by the scroll through part 514 and the openings 414 and 424. As the fan member 300 is operated, the fluid introduced into the inner space of the flow passage-forming member 400 flows out to the outside in the radial direction of the flow passage-forming member 400.

The outflow passage 0.F extends to the outside of the air blower 1 while forming a predetermined angle with respect to the outer circumference of the flow passage-forming member 400. In an embodiment, the predetermined angle may be an acute angle.

In this case, the scroll opening 513 formed in the first scroll 500*a* and the scroll opening 513 formed in the second scroll 500*b* are disposed at different positions along the outer circumferential direction of the scroll unit 500. In addition, as described above, the first rib 413 and the second rib 423 of the flow passage-forming member 400 are formed to extend in different directions.

Accordingly, the outflow passage 0.F passing through the first portion 410 and the outflow passage 0.F passing through the second portion 420 may extend in different directions. Accordingly, the outflow passage 0.F may extend in various directions even when the scroll unit 500 is not rotated.

Referring to FIG. 11(*b*), a state in which the scroll unit 500 is rotated and the extension direction of the outflow passage 0.F is adjusted is illustrated.

In the illustrated embodiment, the first scroll 500*a* positioned on the left is rotated counterclockwise, so that the scroll opening 513 is positioned more to the left. In addition, the second scroll 500*b* located on the right is rotated clockwise, so that the scroll opening 513 is positioned more to the right.

Accordingly, the outflow passage 0.F may extend in more various directions compared to a state in which the scroll unit 500 is not rotated.

Figure 12:
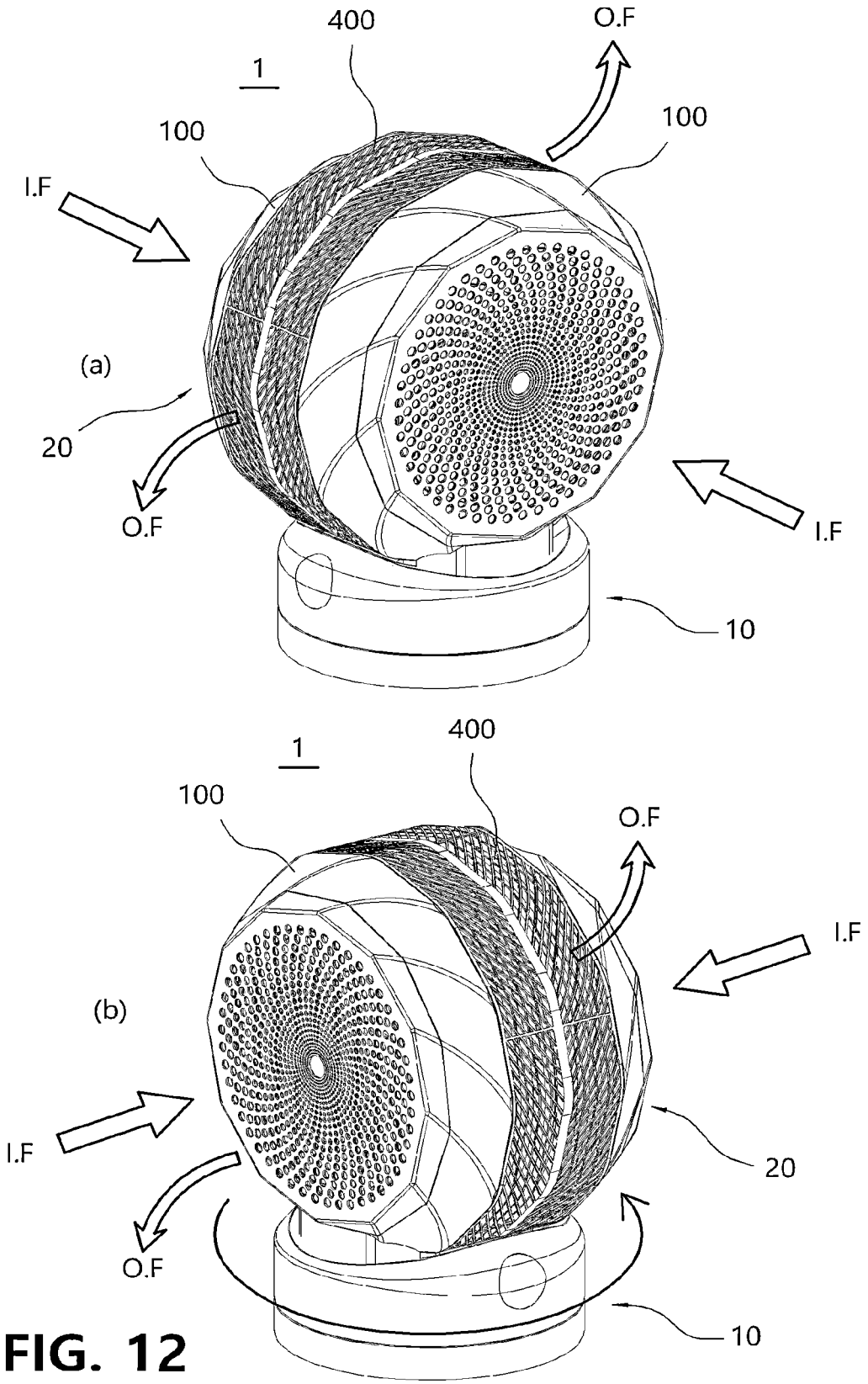
FIG. 12 is a perspective view illustrating an example in which an air flow path is changed by rotating the flow passage-forming member of the air blower of FIG. 1.

Referring to FIG. 12, another example of an inflow passage 1.F and an outflow passage 0.F formed by an air blower 1 according to an exemplary embodiment of the present invention is illustrated.

In the present embodiment, the head unit 20 is rotated around its height direction, that is, the up-down direction in the illustrated embodiment, so that the outflow passage 0.F may extend in more various directions.

Referring to FIG. 12(*a*), the inflow passage 1.F extends into the air blower 1 while forming a predetermined angle with respect to the covers 111 and 121 of the housing 100. In an embodiment, the predetermined angle may be a right angle.

Meanwhile, the inner space of the flow passage-forming member 400 communicates with the outside by the scroll through part 514 and the openings 414 and 424. As the fan member 300 is operated, the fluid introduced into the inner space of the flow passage-forming member 400 flows out to the outside in the radial direction of the flow passage-forming member 400.

The outflow passage 0.F extends to the outside of the air blower 1 while forming a predetermined angle with respect to the outer circumference of the flow passage-forming member 400. In an embodiment, the predetermined angle may be an acute angle.

In this case, the scroll opening 513 formed in the first scroll 500*a* and the scroll opening 513 formed in the second scroll 500*b* are disposed at different positions along the outer circumferential direction of the scroll unit 500. In addition, as described above, the first rib 413 and the second rib 423 of the flow passage-forming member 400 are formed to extend in different directions.

Accordingly, the outflow passage 0.F passing through the first portion 410 and the outflow passage 0.F passing through the second portion 420 may extend in different directions. Accordingly, the outflow passage 0.F may extend in various directions even when the scroll unit 500 is not rotated.

Referring to FIG. 12(*b*), a state in which the head unit 20 and the seating member 12 are rotated by a predetermined angle counterclockwise is illustrated.

As the head unit 20 and the seating member 12 are rotated, the inflow passage 1.F and the outflow passage 0.F are also rotated in the same direction and angle as the head unit 20. In the illustrated embodiment, the inflow passage 1.F and the outflow passage 0.F are rotated by a right angle counterclockwise around the Z axis, that is, the up-down direction as the axis.

Accordingly, the outflow passage 0.F may extend in more various directions compared to a state in which the head unit 20 is not rotated.

Although not shown, the scroll unit 500 and the head unit 20 may be controlled to rotate simultaneously. That is, the examples illustrated in FIGS. 11 and 12 may proceed simultaneously. In the above embodiment, the outflow passage 0.F may extend in more various directions, so that the fluid flowing out may more effectively diffuse into the external space.

Although exemplary embodiments of the present invention have been described, the idea of the present invention is not limited to the embodiments set forth herein. Those of ordinary skill in the art who understand the idea of the present invention may easily propose other embodiments through supplement, change, removal, addition, etc. of elements within the same idea, but the embodiments will be also within the scope of the present invention.

| <Description of Symbols> | |
|---|---|
| 1: air blower | 10: neck unit |
| 11: base | 12: seating member |
| 13: manipulation unit | 20: head unit |
| 100: housing | 110: first housing |
| 111: first cover | 112: first filter support part |
| 113: first filter accommodation part | 114: first vortex-forming member |
| 120: second housing | 121: second cover |
| 122: second filter support part | 123: second filter accommodation part |
| 124: second vortex-forming member | 200: filter member |
| 210: first filter | 220: second filter |
| 300: fan member | 310: blade |
| 320: rotation shaft | 330: fan motor |
| 340: rotation support part | 400: flow passage-forming member |
| 410: first portion | 411: first scroll accommodation part |
| 412: first outer circumferential part | 413: first rib |
| 414: first opening | 420: second portion |
| 421: second scroll accommodation part | 422: second outer circumferential part |
| 423: second rib | 424: second opening |
| 430: partition wall | 440: fan accommodation part |
| 500: scroll unit | 500a: first scroll |
| 500b: second scroll | 510: scroll body |
| 511: plate member | 512: scroll outer circumferential part |
| 513: scroll opening | 514: scroll through part |
| 520: scroll gear | 521: toothing part |
| 530: scroll motor | 540: driving gear |
| I.F: inflow passage | O.F: outflow passage |

What is claimed is:

1. An air blower, comprising:

a fan member rotatably provided to provide transfer force to a fluid;

a flow passage-forming member that accommodates the fan member, has a space formed to communicate with the outside, and includes an outer circumference surrounding the fan member;

a scroll unit rotatably accommodated in the space of the flow passage-forming member; and a housing that communicates with the space of the flow passage-forming member and the outside, covers the space of the flow passage-forming member and the scroll unit, and is coupled to the flow passage-forming member, wherein the scroll unit comprises:

a scroll motor fixedly coupled to the housing;

a scroll body coupled to the scroll motor and rotated by the operation of the scroll motor; and a scroll opening formed through a radial outer circumference of the scroll body and communicating the space of the flow passage-forming member with the outside, and wherein when the fan member is operated, external fluid flows into the space in the axial direction of the flow passage-forming member and is discharged in the outer circumferential direction of the flow passage-forming member through the scroll opening, and as the scroll unit is rotated, the position of the scroll opening changes, and the direction in which the fluid is discharged to the outside is adjusted.

2. The air blower of claim 1, wherein a plurality of the scroll units are provided, and the plurality of scroll units are arranged side by side along an axial direction of the flow passage-forming member in the space of the flow passage-forming member.

3. The air blower of claim 1, wherein the scroll unit comprises:

a first scroll positioned to be biased on one side of the space of the flow passage-forming member; and a second scroll positioned to be biased on the other side of the space of the flow passage-forming member, and the scroll motor is provided on each of the first scroll and the second scroll, and the first scroll and the second scroll are configured to rotate independently of each other.

4. The air blower of claim 3, wherein the fan member is configured to suck the fluid through one side and the other side in the axial direction, a portion of the fluid introduced into the space of the flow passage-forming member passes through the scroll opening of the first scroll and is discharged to the outside, and the remaining portion of the fluid introduced into the space of the flow passage-forming member passes through the scroll opening of the second scroll and is discharged to the outside.

5. The air blower of claim 1, wherein the flow passage-forming member comprises:

a partition wall extending in the cross-sectional direction and partitioning the space into a plurality of spaces, and wherein the scroll unit comprises:

a first scroll and a second scroll disposed to face each other with the partition wall therebetween.

6. The air blower of claim 5, wherein the scroll motors provided in each of the first scroll and the second scroll are controlled independently of one or more of operation status, rotation speed, and rotation direction.

7. The air blower of claim 5, wherein the first scroll is rotated in one direction of the clockwise direction and the counterclockwise direction, and the second scroll is rotated in the other direction of the clockwise direction and the counterclockwise direction.

8. The air blower of claim 5, wherein the first scroll and the second scroll are rotated the same in one or more of a rotation direction and a rotation speed.

9. The air blower of claim 1, wherein the scroll unit comprises:

a scroll gear located inside the scroll body and coupled to the scroll body to rotate together; and a driving gear coupled to the scroll motor and gear-fitted with the scroll gear.

10. The air blower of claim 9, wherein on the outer circumference of the scroll gear, a plurality of toothing parts that are gear-fitted with the driving gear are formed.

11. The air blower of claim 9, wherein on the inner circumference of the scroll gear, a plurality of toothing parts that are gear-fitted with the driving gear are formed.

12. The air blower of claim 1, wherein the scroll unit comprises:

a plate member formed in a plate shape having a shape corresponding to the space of the flow passage-forming member; and a scroll outer circumferential part extending along the outer circumference of the plate member, protruding from the plate member, and surrounded by the outer circumference of the flow passage-forming member, and the scroll opening is formed through the scroll outer circumferential part and is formed to extend along the outer circumference of the plate member by a length shorter than the scroll outer circumferential part.

13. The air blower of claim 1, wherein inside the housing, a filter member configured to filter fluid introduced into the space of the flow passage-forming member by the fan member is accommodated.

14. The air blower of claim 13, wherein the filter member comprises:

a first filter positioned to be biased on one side of the fan member; and a second filter positioned to be biased on the other side of the fan member, and disposed to face the first filter with the fan member interposed therebetween.

15. The air blower of claim 1, wherein the flow passage-forming member comprises:

a scroll accommodation part that is a space for accommodating the scroll unit;

an outer circumferential part surrounding the scroll accommodation part from the radially outer side; and a plurality of ribs formed on the outer circumferential part and extending at a predetermined angle with respect to the axial direction of the flow passage-forming member, and the plurality of ribs are arranged to be spaced apart from each other, and the space of the flow passage-forming member communicates with the outside through a space between the ribs adjacent to each other.

16. The air blower of claim 15, wherein a plurality of the scroll units are provided, and the plurality of scroll units are arranged side by side along the axial direction of the flow passage-forming member in the space of the flow passage-forming member, the flow passage-forming member comprises:

a first portion arranged to surround the outer circumference of any one scroll unit of the plurality of scroll units; and a second portion arranged to surround the outer circumference of another scroll unit of the plurality of scroll units, and the ribs formed in each of the first portion and the second portion extend in different directions.

17. The air blower of claim 15, wherein among the plurality of ribs, the ribs adjacent to each other extend parallel to each other.

18. The air blower of claim 1, further comprising a neck unit supporting the flow passage-forming member, wherein the neck unit is provided on an external body part to be rotatable around the axial direction of the neck unit, the flow passage-forming member is rotated with respect to the axial direction of the neck unit, and the scroll unit is rotated with respect to the axial direction of the flow passage-forming member.

* * * * *